US005992961A

United States Patent [19]

Ishikawa et al.

[11] Patent Number: 5,992,961

[45] **Date of Patent: *Nov. 30, 1999**

[54] INK JET RECORDING APPARATUS, METHOD FOR DETERMINING REDUCED INK REMAINS, AND INFORMATION PROCESSING APPARATUS

[75] Inventors: Tetsuya Ishikawa, Yokohama; Osamu Asakura, Sagamihara; Masasumi Nagashima, Yokohama; Yoshiyuki Shimamura, Yokohama; Kenji Kawazoe, Yokohama; Kazuya Iwata, Yokohama; Seiji Takahashi, Yokohama; Yuji Kanome, Yokohama; Takahiro Ohde, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/502,762

[22] Filed: Jul. 14, 1995

[30] Foreign Application Priority Data

Jul. 15, 1994 [JP] Japan ..... 6-164407
Jun. 13, 1995 [JP] Japan ..... 7-146241

[51] Int. Cl.[6] ..... B41J 2/195
[52] U.S. Cl. ..... 347/7
[58] Field of Search ..... 347/7, 23, 60

[56] References Cited

U.S. PATENT DOCUMENTS

| | | | |
|---|---|---|---|
| 4,183,029 | 1/1980 | Isayama et al. | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,626,875 | 12/1986 | Hara et al. | 346/140 R |
| 4,636,814 | 1/1987 | Terawawa | 346/140 R |
| 4,700,754 | 10/1987 | Kringe | 141/95 |
| 4,723,129 | 2/1988 | Endo et al. | 346/1.1 |
| 4,740,796 | 4/1988 | Endo et al. | 346/1.1 |
| 4,777,494 | 10/1988 | Shibata et al. | 346/1.1 |
| 4,782,754 | 11/1988 | Pohlig | 101/364 |
| 4,788,861 | 12/1988 | Lichti | 73/304 R |
| 4,866,460 | 9/1989 | Shiozaki | 346/140 R |
| 5,051,759 | 9/1991 | Karita et al. | 346/140 R |
| 5,070,346 | 12/1991 | Mochizuki et al. | 346/140 R |
| 5,289,211 | 2/1994 | Morandotti et al. | 346/140 R |

(List continued on next page.)

FOREIGN PATENT DOCUMENTS

| | | |
|---|---|---|
| 54-056847 | 5/1979 | Japan . |
| 59-075122 | 4/1984 | Japan . |
| 59-123670 | 7/1984 | Japan . |
| 59-138461 | 8/1984 | Japan . |
| 60-071260 | 4/1985 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

An ink jet recording apparatus is provided with at least one first electrode at least in either a recording head or ink retaining member, dielectric adjacent to the first electrode or laying between the first electrodes, a second electrode electrically connected to the first electrode through the dielectric and ink, power supply to apply and release voltage to and from the first electrode, potential difference detector for detecting the potential of the second electrode, and equivalent circuit to determine the ink remains at least in either one of the recording head and ink retaining member in accordance with the potential of the second electrode detected by potential difference detector. In this way, it is possible to provide an ink jet recording apparatus having equivalent circuit for detecting ink shortage, and expect a highly precise detection thereof, and also, to provide information processing systems having such recording apparatus for its output device.

20 Claims, 16 Drawing Sheets

U.S. PATENT DOCUMENTS 5,329,304 7/1994 Koizumi et al. ..... 347/7
5,357,347 10/1994 Hirose et al. ..... 358/296
5,477,249 12/1995 Hotomi ..... 347/48
5,488,395 1/1996 Takayanagi et al. ..... 347/7
5,590,510 1/1997 Mochizuki et al. ..... 53/434
5,617,121 4/1997 Tachihara et al. ..... 347/7

INK JET RECORDING APPARATUS, METHOD FOR DETERMINING REDUCED INK REMAINS, AND INFORMATION PROCESSING APPARATUS

BACKGROUND OF THE INVENTION

1. Field of the Invention

The present invention relates to an ink jet recording apparatus for outputting characters, images, and other information on a recording medium, a method for determining reduced ink remains of the ink jet recording apparatus, and an information processing apparatus using the ink jet recording apparatus as its output means, such as a copying machine, a facsimile apparatus, a printer, a wordprocessor, and a computer.

2. Related Background Art

Recording apparatuses to perform recording on a recording medium, paper, cloth, plastic sheet, or OHP sheet (hereinafter just referred to as a recording sheet), have hitherto been proposed with various recording methods, such as wire dot, thermosensitive, or ink jet in the mode that its recording head is mountable.

Of these methods, the ink jet is one of the non-impact types where ink is discharged onto a recording sheet to which it adheres directly in lower noises. By the formation methods of ink droplets and methods of generating discharge energy, this method is roughly divided into a continuous method (including charged particle controlling, and spraying), and on-demand method (including such as to use piezoelectric, spark, or bubble jet method).

The continuous method is such that ink is continuously discharged, and only needed ink droplets are charged. The charged droplets are allowed to adhere to the recording sheet while others are discarded. In contrast, the on-demand method is such that ink is discharged only when it is needed for printing and, therefore, no ink is wasted without staining the interior of the apparatus. Also, the on-demand method is arranged to start or suspend ink discharge as required. Consequently, its response frequency is low as compared to the continuous method. This lower frequency is compensated with an increased number of nozzles in order to materialize a higher recording. Therefore, most of the recording apparatuses currently in use are of the on-demand type. Since it is possible for a recording apparatus provided with an ink jet method of the kind to execute recording operations in high density at high speeds, this apparatus is utilized and practically adopted as an output means of an information processing system serving as a printer for a copying machine, a facsimile apparatus, an electronic typewriter, a word processor, or a work station, or adopted as a handy or portable printer provided for a personal computer, a host computer, an optical disc device, or a video apparatus, for example. In such cases, each of the ink jet recording apparatuses is arranged in accordance with the functions, modes of use, and other characteristics of the respective equipment for which each of them is adopted.

As an ink jet recording apparatus in general, it comprises a carriage having recording means (recording head) and ink tank mounted thereon, means for feeding recording sheets, and means for controlling them. Then, a recording head, which is capable of discharging ink droplets from a plurality of discharge ports, is arranged to scan serially in the direction (main scanning direction) perpendicular to the feeding direction (sub-scanning direction) of a recording sheet, while the recording sheet is intermittently fed in an amount equal to the recording width at the time of the recording head is being disengaged from recording operation. This recording method is to discharge ink on a recording sheet for recording in response to recording signals. It is widely used as a quiet recording method, which is operable at low running costs. Also, with a recording head in which many numbers of nozzles are arranged on a straight line for discharging ink in the sub-scanning direction, the recording is performed by one-time scan of the recording head on a recording sheet in a width that corresponds to the nozzle numbers. Therefore, it is possible to attain a higher speed recording.

Further, in a case of an ink jet recording apparatus capable of recording in colors, color images are formed by superposing ink droplets discharged from a plurality of recording heads for color use. In general, when a color recording is executed, it is required to prepare recording heads for the three primary colors, yellow (Y), magenta (M), and cyan (C) or four kinds of recording heads and ink cartridges for use of the three primary colors and one black (Bk). In recent years, the apparatuses, which are capable of forming images in full colors, have been practically in use by means of recording heads for three to four colors.

Moreover, it is comparatively easy for an ink jet recording apparatus of the kind to arrange its structure so that it can record on a large sheet in A-1 size. In other words, recording apparatuses, a printer for use of CAD output or some other plotters, for example, have been actually manufactured to execute color recording on a recording sheet of A-1 size. Here, a source document is copied on it by connecting an image reader to the ink jet recording apparatus. Also, there have been various demands on different uses of the recording apparatus of this type. Particularly, it has been increasingly required to make the apparatus capable of recording on OHP films that may be used for projection of presentations in conferences, lectures, or the like. In order to meet such demands, the development and production are being attempted to provide an apparatus capable of recording on a selected medium as desired in an excellent condition at any time, irrespective of the kinds of recording media having different characteristics of ink absorption, for example.

In addition, ink jet recording apparatuses are increasingly on demand in wider fields of industries (in an apparel industry or the like, for example) as an excellent recording means. Thus it is required still more to provide images in a higher quality.

In this respect, however, the conventional ink jet recording apparatuses present a problem as its drawback in some cases that ink runs out while in printing. More specifically, when an automatic sheet feeder is installed on a recording apparatus to execute printing on a plurality of recording sheets in succession by use of a continuous sheet feeding, for example, there is a possibility that ink is completely consumed while in printing (hereinafter referred to as "ink shortage"). Here, the following problems are also encountered. For example, unless the user is informed of such ink shortage, the time that is taken in printing after the "ink shortage" is just a waste. Also, the unclear printing continues in the so-called "scratchy letters" immediately before the ink shortage. As a result, a number of recording sheets are used wastefully in some cases.

Also, in an ink jet recording apparatus of bubble jet type using electrothermal transducing elements, not only the problems occur as described above, but those given below will take place. In other words, if the discharge heaters of the recording head are driven continuously in a state that no ink is present in the ink discharge ports, the recording head is caused to be overheated, leading to drawbacks such as deformation or damages brought to the recording head in some cases.

Therefore, in order to avoid such drawbacks, there have been invented various means for detecting ink shortage (means for detecting ink remains) in recent years. As means for detecting ink shortage, a structure has been proposed, for example, wherein an ink tank is formed by an elastic material, and then, the deformation of the ink tank, which takes place along the reduction of ink contained ink in it, is detected by a mechanical switch. Also, a method has been proposed, in which detection current flows across two electrodes installed dedicatedly therefor in positions directly in contact with ink in the ink tank so as to detect the resistance value across them for sensing the reduction of ink remains. Also, a method is known, in which discharged dot numbers are summed up and stored in order to estimate the accumulated amount of ink consumption and predict the time of ink shortage.

For the structure or methods described above, however, it is necessary to prepare the member dedicated to sensing the ink shortage. As a result, significant cost increase is inevitable, yet a problem is still encountered that the detection of ink shortage obtainable by the proposed structure or methods is not sufficiently precise.

SUMMARY OF THE INVENTION

With a view to solving the problems described above, the present invention is designed. It is an object of the invention to provide an ink jet recording apparatus having means for executing the detection of ink shortage at lower costs, yet in a higher precision expected to be obtainable in sensing such ink shortage as described above, and also, to provide a method for determining the reduced ink remains, and an information processing apparatus provided with the recording apparatus as its output means.

It is another object of the present invention to provide an ink jet recording apparatus to perform recording by use of recording means for recording the inputted image information by discharging ink onto a recording medium, and an ink retaining member to supply ink to such recording means, comprising at least one of first electrodes arranged for at least either one of the aforesaid recording means and ink retaining member; dielectric adjacent to the aforesaid first electrode or lying between the first electrodes; second electrode electrically connected to the first electrode through the dielectric and ink; means for applying and releasing voltage to and from the aforesaid first electrode; means for detecting the potential of the aforesaid second electrode; and means for determining the reduced ink remains at least in either one of the recording means and ink retaining member in accordance with the potential of the second electrode detected by the aforesaid means for detecting potential.

It is still another object of the present invention to provide an information processing apparatus having the aforesaid recording apparatus as its output means, such as a copying machine, facsimile apparatus, printer, wordprocessor, and personal computer.

It is a further object of the present invention to provide an ink jet recording apparatus to perform recording by use of recording means for discharging ink onto a recording medium, comprising at least one of first electrodes arranged at least for one of the aforesaid recording means; dielectric adjacent to the aforesaid first electrode or lying between a plurality of the first electrodes; second electrodes electrically connected to the first electrodes through the dielectric and ink; means for applying voltage to apply and release voltage to and from the aforesaid first electrodes; means for detecting the potential of the aforesaid second electrodes, which is generated when voltage is applied to the first electrodes; and means for determining the reduced ink remains in accordance with the potential of the second electrodes detected by the aforesaid means for detecting potential.

It is still a further object of the present invention to provide a method for determining reduced ink remains in an ink jet recording apparatus to perform recording by use of recording means for discharging ink onto a recording medium, which is provided with at least one of first electrodes, dielectric adjacent to the first electrode or lying between a plurality of the first electrodes, and second electrode electrically connected to the first electrodes through the dielectric and ink, comprising the steps of detecting the potential of the second electrode generated when voltage is applied to the first electrodes, and of determining the reduced ink remains in accordance with the result of such potential detection for the second electrode.

In accordance with the present invention, the ink jet recording apparatus utilizes the electric capacitance partially or totally retained by recording means, while providing the first electrodes, and the second electrode having the dielectric and ink used for recording, which lie between the first and second electrodes, and then, the apparatus detects the potential that appears on the second electrode when voltage is applied to the first electrodes. In this way, the current status of ink between the first and second electrodes is detected; thus making it possible to determine whether discharging is still possible or impossible. Here, the electrodes already installed for the ink discharge heaters, ink warming heaters, or the like can be utilized as the first electrodes, and the heat storage layer of $SiO_2$ film or the like, which covers the base board to form the aforesaid discharge heaters and others on it, can be utilized as the aforesaid dielectric, for example. Therefore, it is possible to detect the ink shortage accurately with a simple structure, while minimizing the increase of costs in this respect.

Also, using the present invention it is possible to detect not only the "ink shortage", but also sense the "reduced ink remains" easily by arranging the structure and controlling its system appropriately.

DETAILED DESCRIPTION OF THE PREFERRED EMBODIMENTS

Hereinafter, with reference to the accompanying drawings, the detailed description will be made of the embodiments of a recording apparatus in accordance with the present invention. It is to be understood, however, that the present invention is not limited to the embodiments given below.

(First Embodiment)

Figure 1:
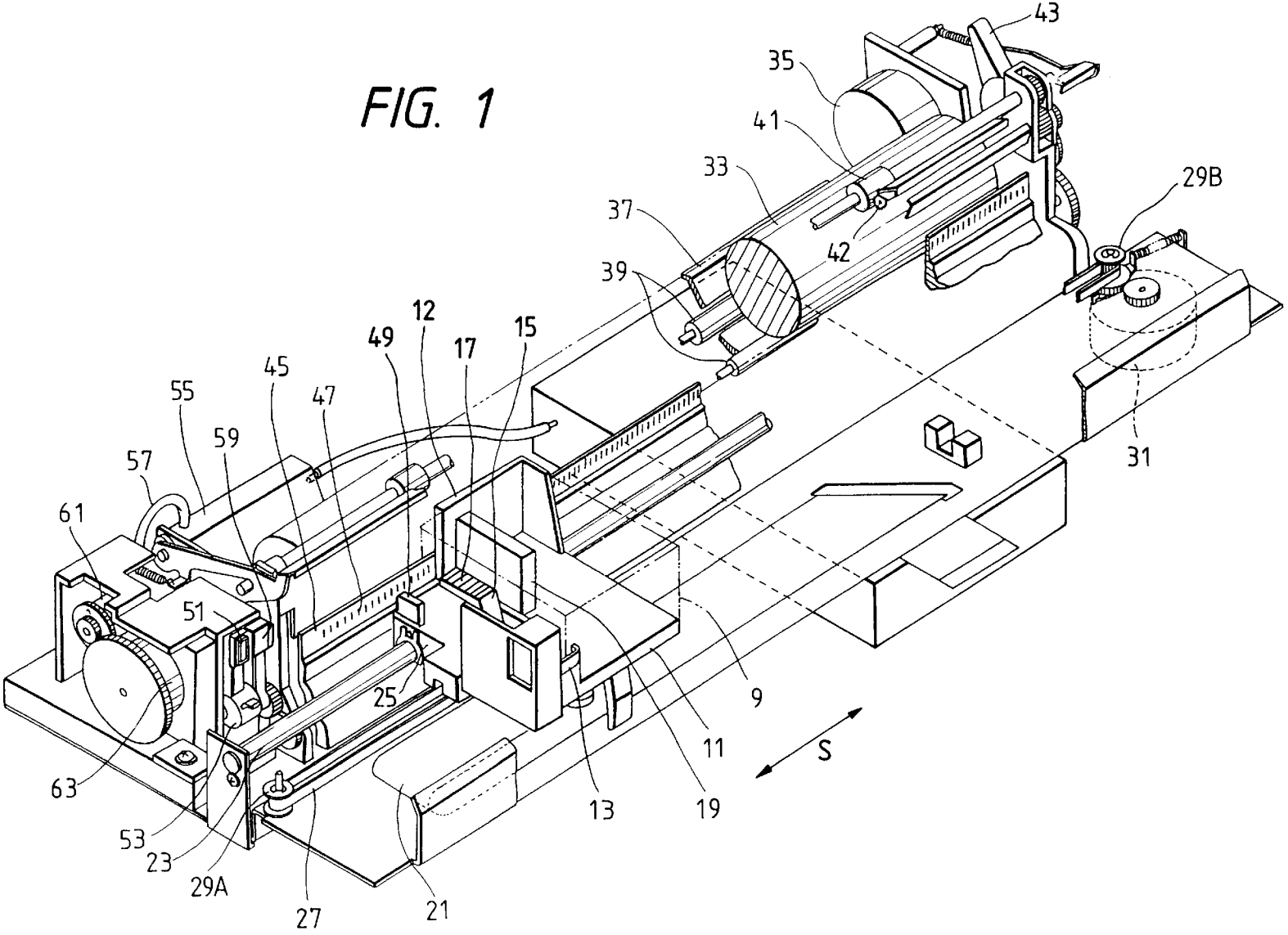
FIG. 1 is a perspective view which schematically illustrates the structure of an ink jet recording apparatus in accordance with the present invention.

FIG. 1 is a perspective view showing one structural example of the printer unit applicable to a recording apparatus in accordance with the present invention.

In FIG. 1, a reference numeral 9 designates a disposable ink head cartridge in which an ink jet recording head is formed integrally with an ink tank to supply ink to the recording head.

As means for generating energy provided for the recording head to discharge ink, there are those using piezoelectric elements or other electromechanical transducing elements, or electrothermal transducing elements having heat generating resistors to give heat to liquid. For the present embodiment, however, a recording head of a type that discharges liquid by the utilization of thermal energy (that is, to utilize film boiling phenomenon: the so-called bubble jet method), is adopted because this method enables the ink discharge ports to be arranged in high density for the execution of recording in high resolution.

Now, a brief description will be made of the formation process of ink droplets by the application of the bubble jet method.

At first, when a heat generating resistor (heater) is heated to a given temperature, film foaming is created to cover the surface of the heater. The inner pressure of this bubble is extremely high to thrust ink in the nozzle. By the inertia created by this thrust, ink is caused to move out of the nozzle, as well as toward the common liquid chamber located in the direction opposite to it. When the movement of ink advances, the inner pressure of the bubble becomes negative, while the resistance of liquid path is being added. As a result, the movement of ink in the nozzle becomes slower. The ink discharged out of the nozzle port (orifice) has a higher velocity than ink in the nozzle. Consequently, due to the balance among the inertia and resistance of the liquid path, and the contraction of bubble, the surface tension of ink, a pinching occurs in ink to cause separation, thus creating an ink droplet. Then, at the same time that the bubble is contracted, ink is drawn from the common liquid chamber to the nozzle by means of a capillary force to let it wait for the next pulse to be applied.

In this way, the recording head (hereinafter, may also be referred to as an ink jet head) using the electrothermal transducing elements as means for generating energy (hereinafter, may also be referred to as energy generating elements) is able to create bubbles in each ink path one to one by the application of pulse signals to cause electrical driving, and to perform the development and contraction of each bubble instantaneously and appropriately. Hence it is possible to attain the discharge of ink droplets, which is particularly superior in its responding capability. Also, it is possible to make the recording head compact, while sufficiently utilizing the advantages of the IC technologies and micro-machining techniques whose advancement and reliability have been enhanced significantly in the semiconductor field in recent years. Hence, among other advantages, it is easy to achieve a high density assembling at lower costs.

The ink jet cartridge 9 provided with an ink jet recording head of the kind is detachably mounted on a carriage designated by a reference numeral 11, and allowed to travel freely in the main scanning direction (the direction indicated by arrows S in FIG. 1)

A reference numeral 13 designates a hook for installing the ink head cartridge 9 on the carriage 1; 15, a lever to operate the hook 13. For this lever 15, a marker 17 is provided. The marker 17 indicates the calibration on the cover, which will be described later, to make it possible to read the printing position, setting position, or the like of the recording head on the head cartridge.

A reference numeral 19 designates a supporting board to support the electrical connector with respect to the ink head cartridge 9, while 21, a flexible cable coupling the electrical connector and the controller, which is arranged in the apparatus main body.

A reference numeral 23 designates a guide shaft for guiding the carriage 11 in the directions S: the shaft is inserted through a bearing 25. Also, a reference numeral 27 designates a timing belt to which the carriage 11 is fixed. This belt transmits the driving force to the carriage so that it can travel in the directions S. It is tensioned around the pulleys 29A and 29B arranged on both sides of the apparatus, respectively. To one of the pulleys 29B, driving force is transmitted from a carriage motor 31 through a transmission mechanism formed by gears and others.

A reference numeral 33 designates a platen roller for regulating the recording surface of a recording medium, paper or the like (hereinafter may also be referred to as a recording sheet), at the same time, feeding it for recording. This roller is driven by means of a feed motor 35. Also, a reference numeral 37 designates a paper pan for guiding the recording sheet to the recording position; 39, a feed roller arranged on the way of feeding path of the recording sheet to press it toward the platen roller 33 for carrying it on.

A reference numeral 41 designates an exhaust sheet roller arranged on the upstream side in the feeding direction of the recording medium, but on the downstream side of the recording position in order to exhaust the recording medium toward an exhaust sheet outlet (not shown). Meanwhile, a reference numeral 42 designates a spur arranged to face the exhaust sheet roller 41 to press the roller 41 through the recording medium, thus enabling the exhaust sheet roller 41 to exert feeding force with respect to the recording medium; 43, a release lever for removing biasing forces each given to the feed roller 39, pressure plate 45, and spur 42 when setting the recording medium.

The pressure plate 45 serves to suppress the floating or the like of the recording medium in the vicinity of the recording position in order to secure its close contact with the platen roller 33. For the present embodiment, an ink jet recording head of bubble jet type is adopted, as described earlier, so that ink is discharged for recording by use of electrothermal transducing elements (hereinafter referred to as discharge heaters). As a result, the distance between the discharge port formation surface of the recording head, which will be described later, and the recording surface of a recording medium is comparatively minute. Therefore, its gap must be controlled rigidly in order to avoid any contact between the apparatus main body and the discharge port formation surface. Here, the provision of the pressure plate 45 is particularly useful. Further, a reference numeral 47 designates the calibration provided for the pressure plate 45; 49, the marker arranged on the carriage 11 in relation to the calibration. With these elements, it is also possible to read the printing position or setting position of the recording head.

A reference numeral 51 designates a cap formed by an elastic material such as rubber, and positioned to face ink discharge port formation surface of the recording head when it is in the home position. It is supported so as to abut upon or retract from the recording head. The cap 51 is used for the protection of the recording head when it is not in recording operation, including the prevention of ink drying. Also, the cap is used when a discharge recovery process is executed for the recording head. The discharge recovery process means such processes as to exhaust ink forcibly from the ink tank through the ink discharge ports by activating negative pressure in the cap (hereinafter referred to as a discharge recovery process) or as to remove the causes of defective discharge, such as air bubbles, dust particles, and ink that becomes overly viscous and does not fit for recording, by discharging ink from all the discharge ports by driving energy generating elements utilized for ink discharge (hereinafter referred to as a predischarge).

A reference numeral 53 designates a pump to be used for exerting suction force to forcibly exhaust ink, and also, suck ink from the cap 51 where it is retained when executing discharge recovery processes, such as a discharge recovery by means of the forcible ink exhaustion or ink predischarge. Also, a reference numeral 55 designates a waste ink tank to retain the unwanted ink thus sucked by means of the pump 53, and 57, a tube conductively connecting the pump 53 and the ink tank 55.

A reference numeral 59 designates a blade for wiping the discharge port formation surface of the recording head, which is movably supported in a position where it can be extruded to the recording head side for performing the wiping while the head is in the process of traveling, and also, in a retracted position where the blade is not allowed to engage with the discharge port formation surface. Here, a reference numeral 61 designates a motor, and 63, a cam mechanism for driving the pump 53, and the movement of the cap 51 and blade 59 when receiving the driving force from the motor 61.

Now, the detailed description will be made of the structure of the ink head cartridge 9.

Figure 2:
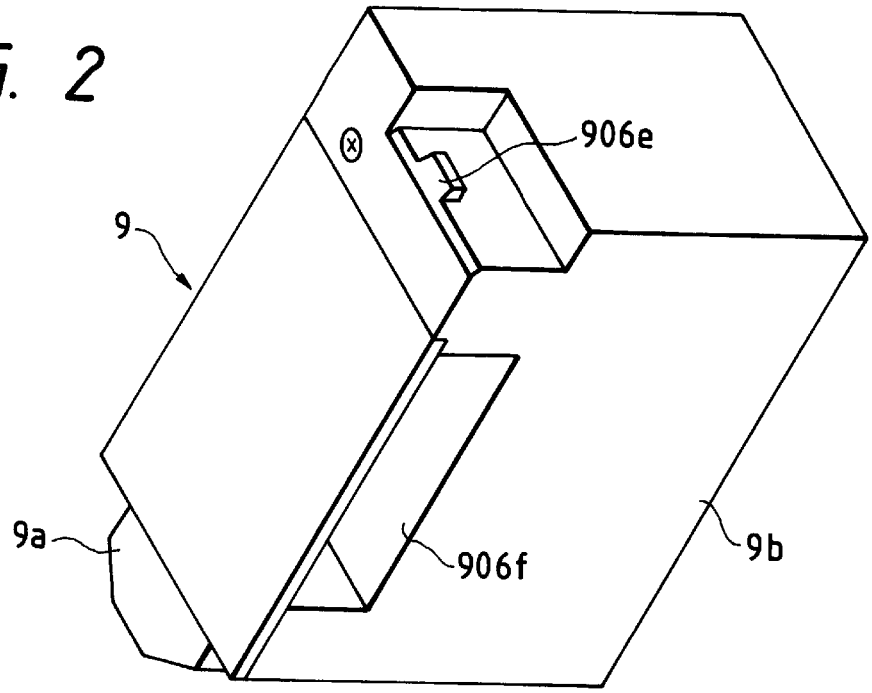
FIG. 2 is a perspective view which schematically illustrates the structure of the head cartridge of deposable type, which is applicable to an ink jet recording apparatus in accordance with the present invention.

FIG. 2 is a perspective view which shows the ink head cartridge 9 described above. In FIG. 2, the ink head cartridge 9 is integrally formed by a discharge unit 9*a* constituting the main body portion of the recording head, and an ink tank 9*b*. Here, in the present embodiment, there is used as a recording head the so-called head cartridge integrally formed with a recording head (discharge unit 9*a* described above) and an ink tank 9*b*. Therefore, in order to simplify the description, the ink head cartridge 9 or discharge unit 9*a* is just referred to as recording means 9 or recording head 9 as the case may be.

A reference numeral 906*e* designates a nail that engages with the hook 13 provided for the carrier 11 when installing the recording head 9. As shown in FIG. 2, the nail 906*e* is arranged inside a portion recessed from the surface of the recording head 9. Also, in the vicinity of the discharge unit 9*a* on the front side of the recording head 9, an abutting portion (not shown) is arranged for setting the position. A reference numeral 906*f* designates an aperture in which the supporting plate 19 planted to stand on the carrier 11 is inserted. The supporting plate 19 is to support the flexible board (electric connector) and a rubber pad.

Figure 3A:
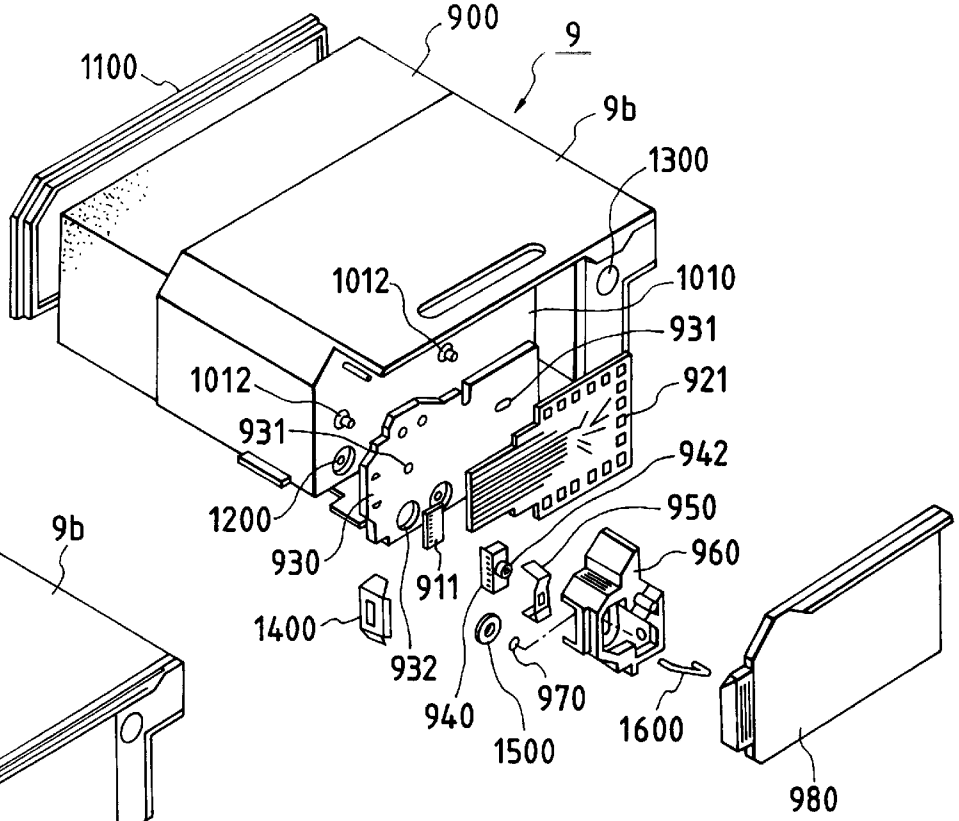
FIG. 3A is a perspective view which schematically illustrates the inner structure of the head cartridge applicable to an ink jet recording apparatus in accordance with the present invention.
Figure 3B:
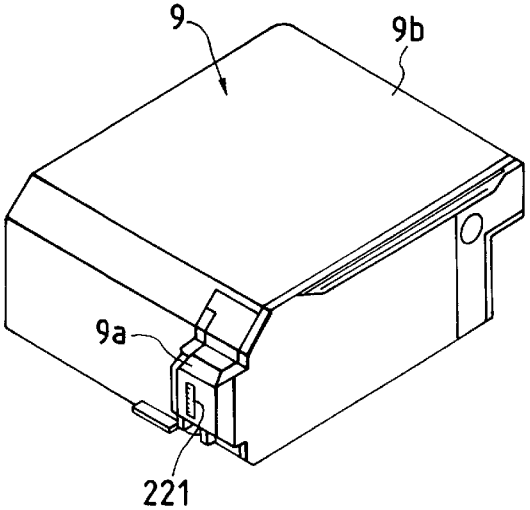
FIG. 3B is a perspective view which schematically illustrates the outer appearance thereof.

FIG. 3A is an exploded perspective view showing the ink cartridge represented in FIG. 2. FIG. 3B is a view showing the external appearance thereof. Here, a reference numeral 911 designates a heater board. The heater board 911 comprises electrothermal transducing elements (discharge heaters), which dually function as first electrodes; ink warming heaters; and wires made of aluminum and others for supplying electricity to these heaters, being formed on an Si substrate by the application of film formation technique. Then, on the surface thereof, a thin film is formed as heat storage layer by $SiO_2$ or the like, which dually functions as the dielectric as described earlier. Further, on the surface thereof, a thin film is formed by Ta (tantalum) to provide protection against cavitation. Here, a reference numeral 921 designates a printed circuit board for the heater board 911 where corresponding wires are connected by means of wire bonding.

A reference numeral 930 designates a base board formed by aluminum and others, which functions as a heat radiation board dually.

A reference numeral 940 designates a ceiling board having partition walls, a common liquid chamber, and others to define ink paths. For the present embodiment, this board is formed by resin material having the plate units for discharge ports integrally arranged on it.

A reference numeral 950 designates a pressure spring. The heater board 911 and the ceiling board 940 are pinched in between the holding edges of the spring to couple them. Then, by the biasing force of the pressure spring 950, the heater board 911 and ceiling board 940 are fixed under pressure. In this respect, the supporting element 930 also functions as a member to radiate heat of the heater board 911 and cool it when driving recording means 9.

A reference numeral 960 designates a sub-tank to receive ink supplied from the ink retaining unit 9*b* serving as the ink supply source, and then, to guide the ink thus received to the common liquid chamber formed by the coupled heater board 911 and ceiling board 940. Also, a reference numeral 970 designates a filter positioned in the sub-tank 960 near the ink supply outlet to the common liquid chamber. This filter 970 prevents any foreign substances or air bubbles from entering the discharge ports. At the same time, this filter functions dually as the second electrode. Further, the filter 970, being formed by a conductor such as stainless steel, its electrical conduction with the printed circuit board 921 is secured by wiring (not shown). In this respect, the reference numeral 980 designates the covering member for the sub-tank 960.

A reference numeral 900 designates an absorbent for containing ink, which is arranged in the main body of the ink tank 9*b*. Also, a reference numeral 1200 designates an ink supply outlet to supply ink to the recording elements (discharge unit) 9*a* formed by each of the constituents 911 to 980 described above. It is possible to allow the absorbent 900 to contain ink by injecting ink from the supply outlet 1200 before the recording elements 9*a* is arranged in the portion at 101 of the main body of ink tank 9*b*. A reference numeral 1100 designates the covering member for the cartridge main body, and 1300, an air conducting port arranged for the covering member to conductively connect the interior of the cartridge to the atmosphere.

When ink is completely filled in the ink tank 9*b* through the ink outlet 1200, the recording unit 9*a* formed by each of the components 911 to 980 is positioned in the portion at 1010 for arrangement. At this juncture, the extrusion 1012 provided for the main body of ink tank 9*b* and the corresponding hole 931 arranged on the supporting element 930 are fitted to position or fix them, for example. In this way, the head cartridge 9 is completed.

Ink in the ink tank 9*b* is supplied to the sub-tank 960 through the supply outlet 1200, the hole 932 arranged on the supporting element 930, an annular chip tank (ink supply tube) 1600, and an inlet port arranged on the back side of the sub-tank 960 shown in FIG. 3A. Ink in the sub-tank 960 flows in the common liquid chamber from the outlet port through an appropriate supply tube and the ink outlet port 942 of the ceiling board 940. For the ink conduction connector described above, a packing formed by silicon rubber, butyl rubber, or the like, for example, is provided to seal it so that each ink supply path is securely obtained.

Here, in the present embodiment, the discharge port unit 9*a,* which serves as the recording head, is ink jet recording means to discharge ink by utilizing thermal energy as described earlier, wherein ink is discharged from each of the discharge ports for recording by utilizing the changes of pressure brought by the development and contraction of air bubble resulting from the film boiling caused by thermal energy applied by the electrothermal transducing elements to generate the thermal energy.

Figure 4:
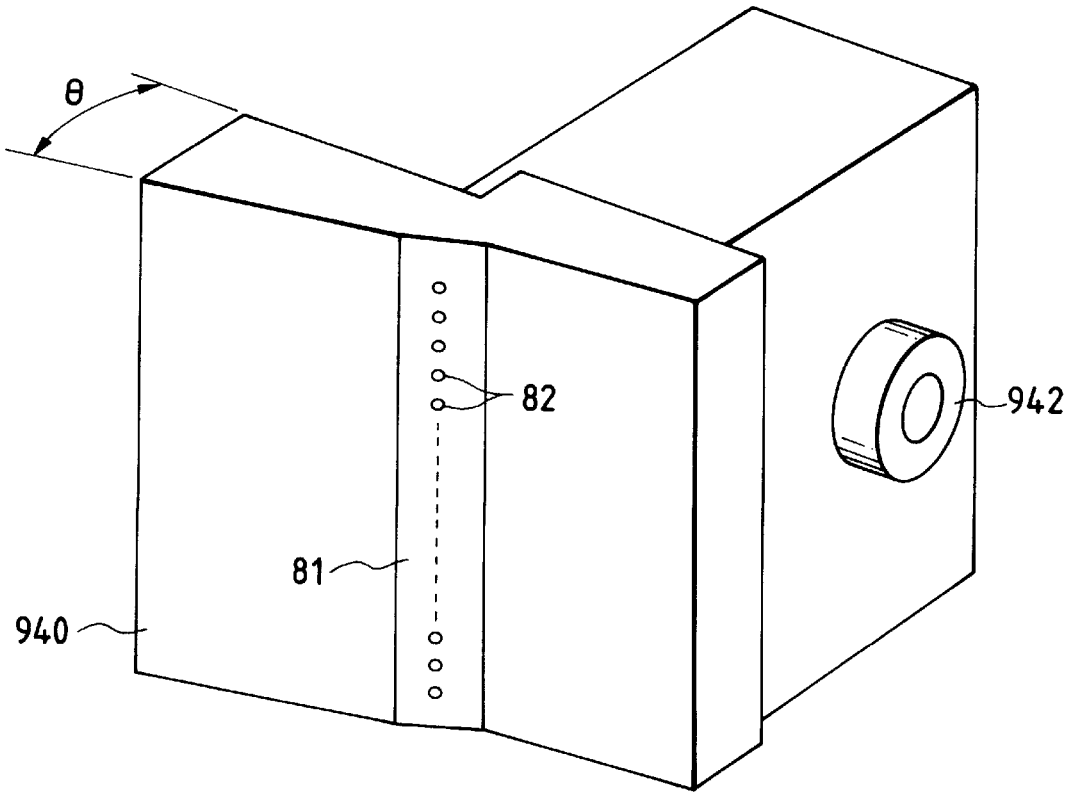
FIG. 4 is a perspective view which shows the ceiling board having a discharge port array for the head cartridge applicable to an ink jet recording apparatus in accordance with the present invention.

FIG. 4 is a perspective view which shows the ceiling board 940 described above. As shown in FIG. 4, the discharge port formation surface on the ceiling board is inclined at a given angle of θ to the plane parallel to the recording surface of a recording medium (recording sheet). Further, this inclination is provided in order to arrange each of the liquid paths in the discharge port plate at a given angle to the liquid path behind each of them so that the discharge ports can be processed by irradiation of laser beam in the position near the discharge ports.

Figure 5A:
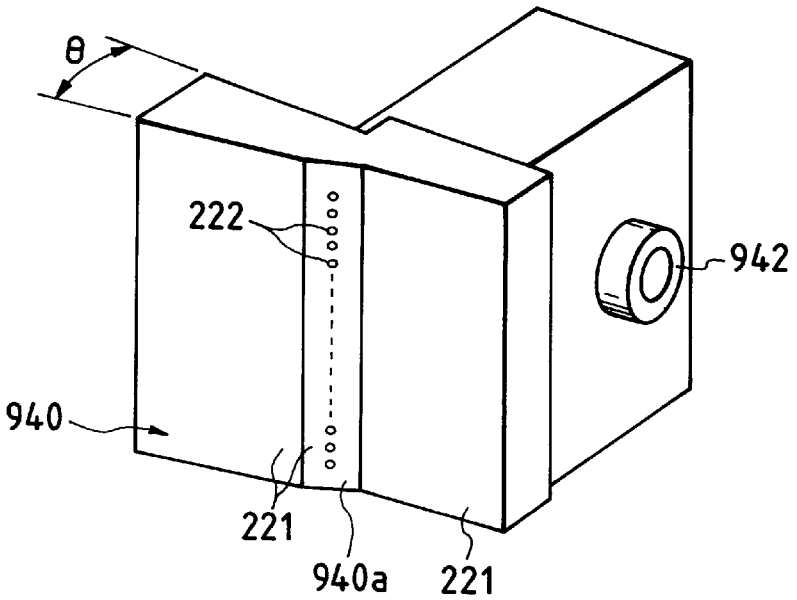
FIG. 5A is a partially perspective view which schematically shows the structure of the discharge port array of ink discharge unit applicable to an ink jet recording apparatus in accordance with the present invention.
Figure 5B:
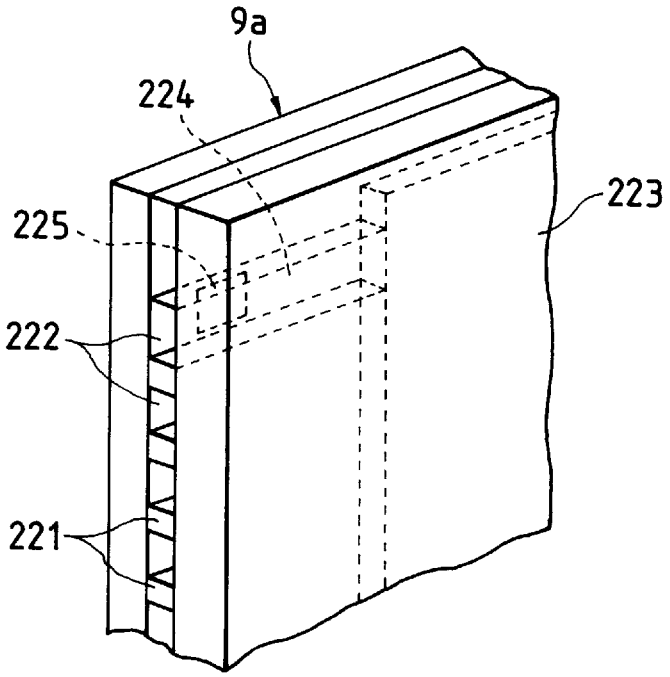
FIG. 5B is a partially perspective view which schematically shows the structure in the range from the discharge ports to a common liquid chamber thereof.

FIG. 5A is a partially perspective view which schematically shows the structure of the discharge port array of the recording head (discharge port unit) 9*a* described above. Likewise, FIG. 5B shows the structure in the range from the discharge ports to the common liquid chamber. In FIGS. 5A and 5B, for the discharge port formation surface 221, which faces a recording material with a given gap (approximately 0.5 to 2.0 mm, for instance), a plurality of discharge ports 222 are formed at given pitches, and then, electrothermal transducing elements (heat generating resistors and others) 225, which generate energy for use of ink discharge, are arranged along the wall of each liquid path 224, which conductively connects the common liquid chamber 223 and each of the discharge ports 222. In the present embodiment, the recording head 9*a* is mounted on the carrier 11 with the positional relations that the discharge ports 222 are arranged in the direction intersecting the traveling direction (main scanning direction) of the carrier 11. Then, each corresponding electrothermal transducing element (heater) 225 is driven (energized) in accordance with the image signals or discharge signals to cause the film boiling in ink in each of the liquid paths 224. The recording head 9*a* is thus structured so that ink is discharged from each discharge port 222 by the application of pressure generated at that time.

Figure 6:
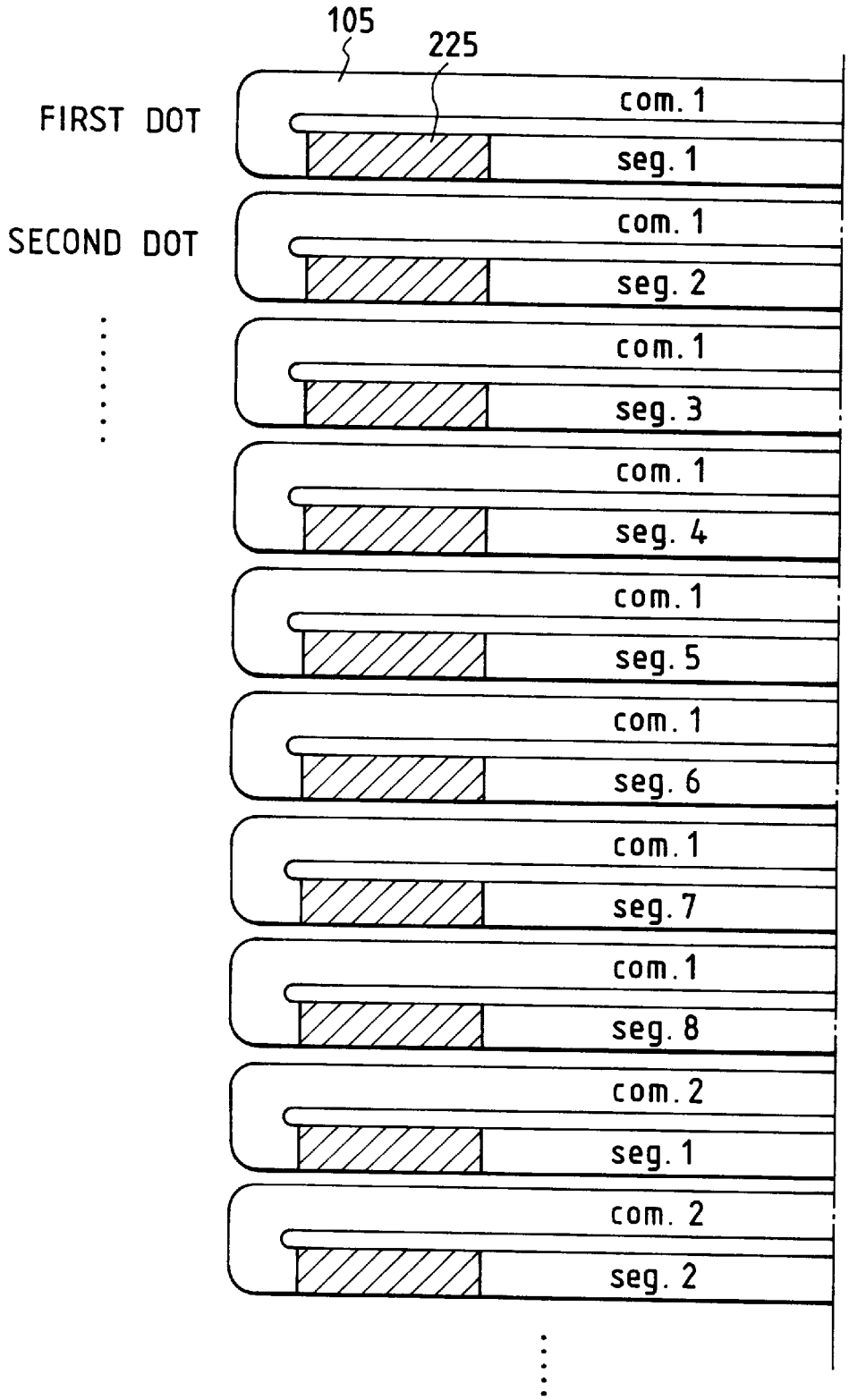
FIG. 6 is a plan view which shows a heater board applicable to an ink jet recording apparatus in accordance with the present invention.
Figure 7:
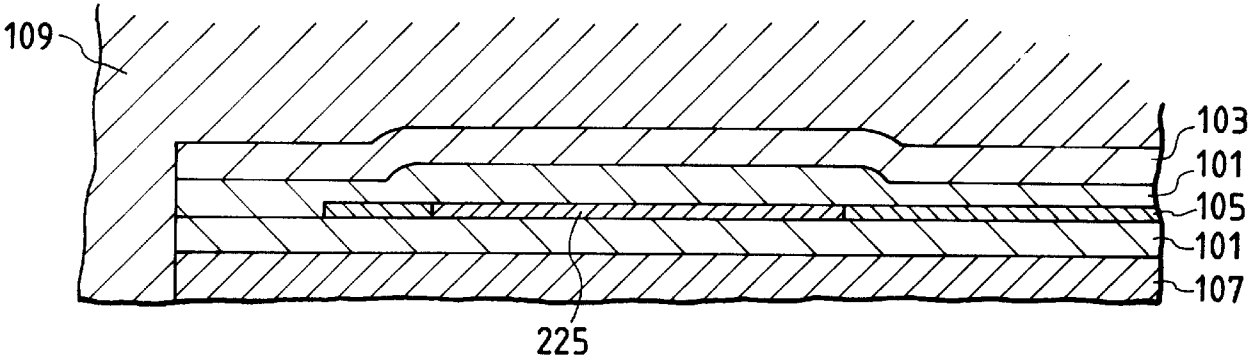
FIG. 7 is a cross-sectional view which shows the heater board applicable to an ink jet recording apparatus in accordance with the present invention.

FIG. 6 is a plan view showing the heater board described above. FIG. 7 is its cross-sectional view. A reference numeral 101 designates a protective film formed by $SiO_2$ as described above; 103, a protective film formed by Ta against cavitation; 105, a wiring structured by Al and others; 107, a substrate formed by Si and other; and 109, ink.

Figure 8:
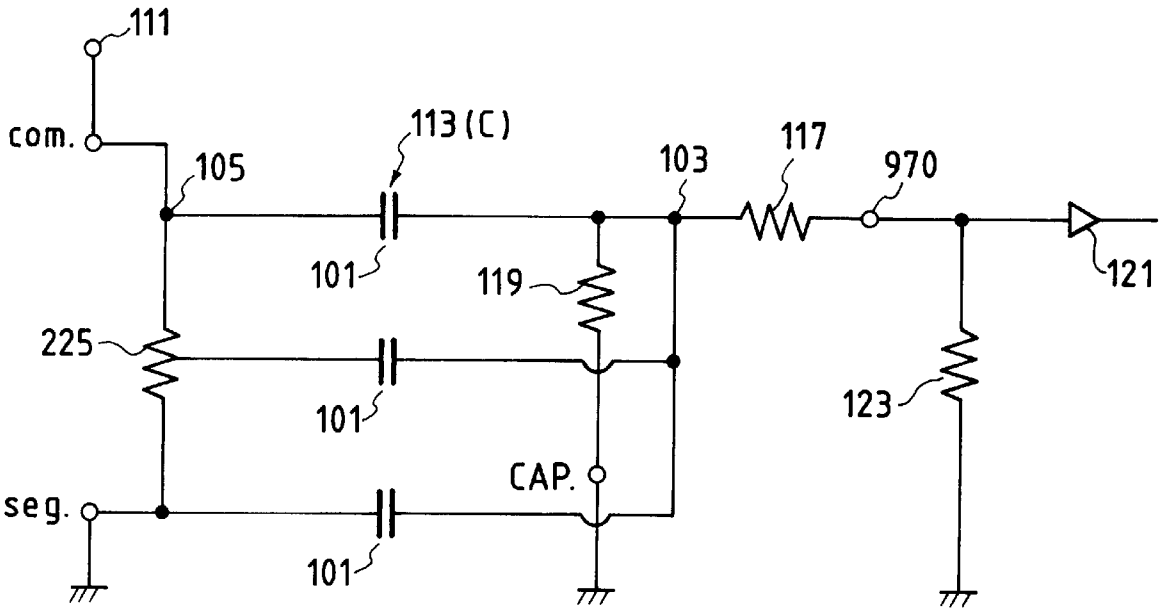
FIG. 8 is a diagram showing the equivalent circuit of a mechanism for detecting ink shortage, which is applicable to an ink jet recording apparatus in accordance with the present invention.
Figure 9:
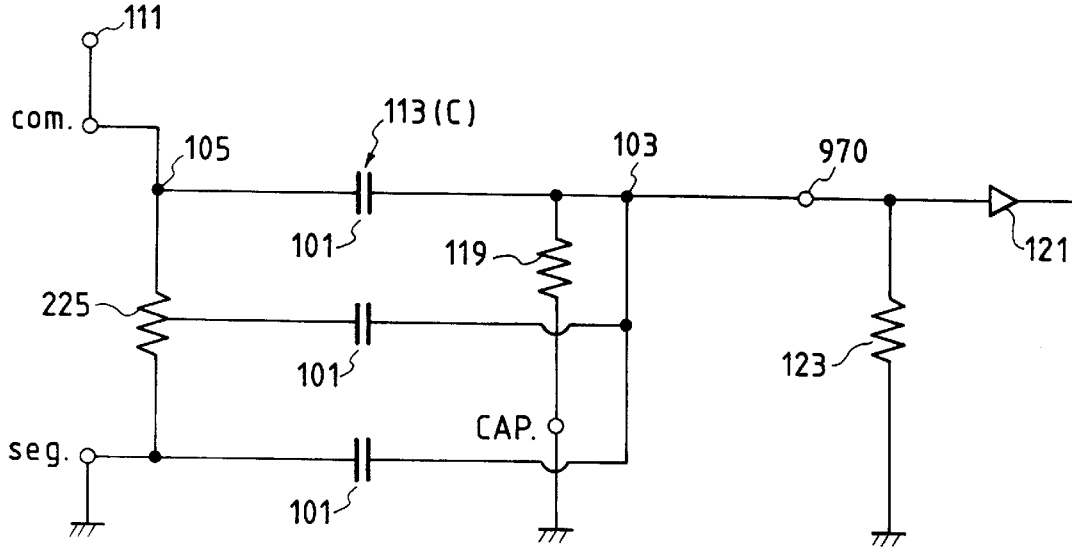
FIG. 9 is a diagram showing the equivalent circuit of a mechanism for detecting ink shortage, which is applicable to an ink jet recording apparatus in accordance with the present invention.

FIG. 8 and FIG. 9 are diagrams showing the equivalent circuit, which illustrates the circuit structure whereby to detect ink shortage by use of the recording head and recording apparatus described above.

FIG. 8 is a diagram which shows the equivalent circuit representing the recording head and recording apparatus before ink has been exhausted. Here, a reference numeral 111 designates a power-supply arranged to drive the discharge heaters of the recording head. Also, a reference numeral 113 designates a capacitor, which functions by means of a wiring formed by a discharge heater 225, or Al or the like connected to the discharge heater, and a protective film 103 against cavitation that covers the heater board, being arranged as polar plates on both sides, while the protective film (heat storage layer) 101 being arranged as its dielectric. A reference numeral 117 represents electrical resistance of ink existing between each of the discharge heaters and the filter described earlier, and 119, electrical resistance being present between the protective film 103 against cavitation and the ground through ink and the heater board substrate.

As clear from the description of the equivalent circuit, when voltage is applied across the common and segment in order to drive the discharge heater, a certain potential is created between the electrode 970 constituting the filter, and the ground of the driving circuit described above.

A reference numeral 121 designates a potential difference detector, such as a differential amplifier, or FET amplifier, having almost indefinite high input impedance to detect the potential difference described above. Also, a reference numeral 123 designates bias resistance having a resistance value of approximately 100 M or several hundreds of MΩ, which is given to prevent any floating status of potential that may occur in the potential difference detector due to ink shortage or the like. With the structure arranged in this way, it is possible to detect in a good precision a potential difference caused by a faint load stored in the capacitor described above.

On the other hand, FIG. 9 shows the equivalent circuit representing the recording head and recording apparatus when ink is completely exhausted and ink 117 is not present on the discharge heater. The potential difference described above is certainly reduced, and brings about a potential difference different from the one represent by the circuit as shown in FIG. 8.

In other words, the ink 117 around the heater board performs a kind of switching function between these conditions of the equivalent circuit described above.

In this respect, it is not necessarily required to arrange the structure as shown in FIG. 8 for the implementation of the present invention. For example, the same effect is obtainable without the provision of the protective layer against cavitation because ink is still functional as the second electrode. Also, the contact with the ground is not necessarily made through the heater board. It may be possible to form between the heaters and heater board a wiring pattern separately, which is arranged to make connection with the ground, for example.

Figure 10:
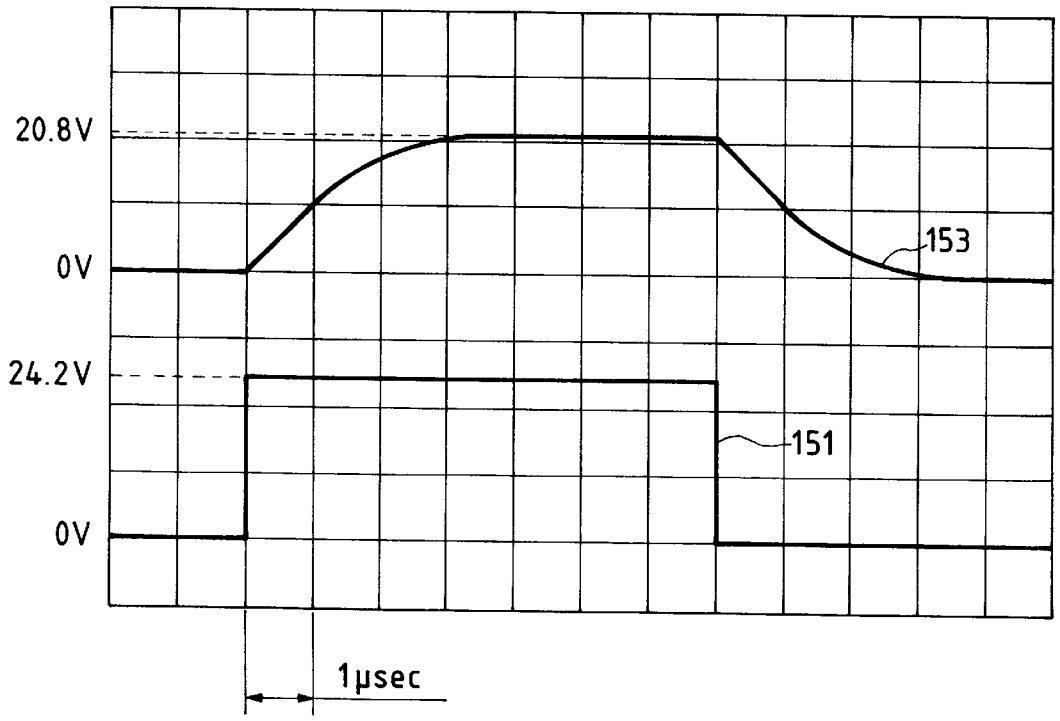
FIG. 10 is a comparative diagram showing the voltage input waveform of the first electrode, and the voltage output waveform of the second electrode, which are applicable to an ink jet recording apparatus in accordance with the present invention.
Figure 11:
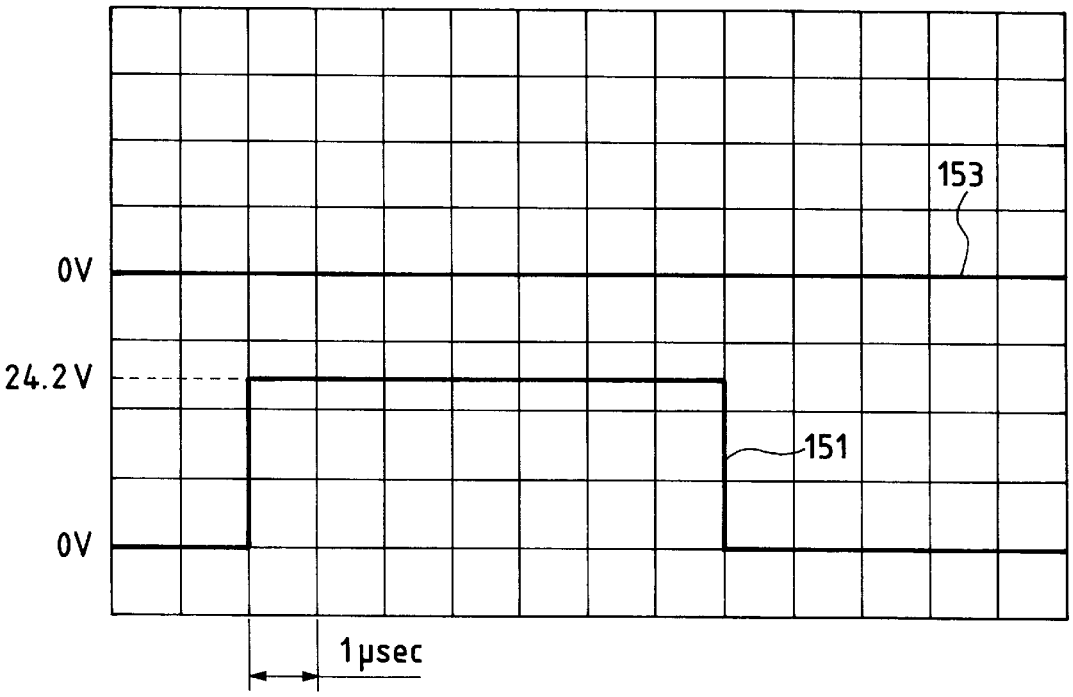
FIG. 11 is a comparative diagram showing the voltage input waveform of the first electrode, and the voltage output waveform of the second electrode, which are applicable to an ink jet recording apparatus in accordance with the present invention.

FIG. 10 and FIG. 11 are diagrams showing the waveform 151 of voltage applied to each heater that corresponds to the representation in FIG. 8 and in FIG. 9, and the waveform 153 that represents the relationship with the potential difference in the electrode 970 at the same time, respectively. Here, the axis of ordinate represents the voltage or potential difference while the axis of abscissa represents time. In this respect, FIG. 10 shows the waveform that appears when predischarge is executed in a state where ink is sufficiently filled. In other words, it shows the waveform that appears when four alternately arranged discharge heaters are driven simultaneously among the eight discharge heaters in one and the same common. On the other hand, FIG. 11 represents the waveform that appears when the four discharge heaters described above are driven simultaneously in a state where ink is completely absent.

Figure 12:
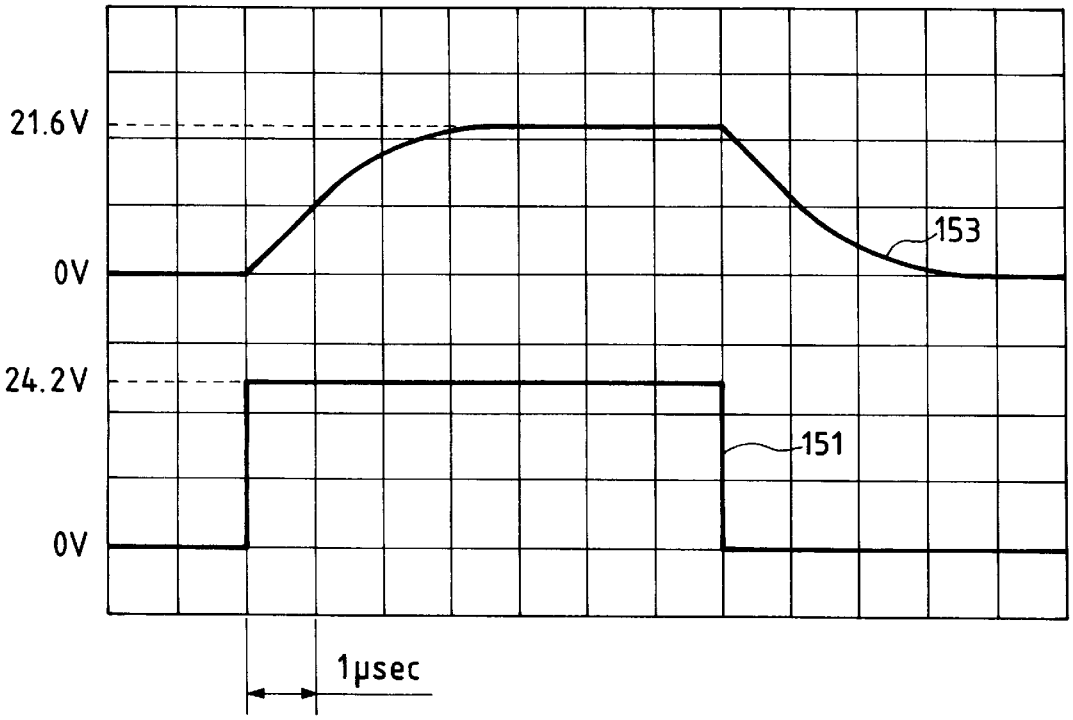
FIG. 12 is a comparative diagram showing the voltage input waveform of the first electrode, and the voltage output waveform of the second electrode, which are applicable to an ink jet recording apparatus in accordance with the present invention.

FIG. 12 shows the waveform that appears when ink is absent on only one discharge heater of those four that are driven simultaneously.

As described above, it is clear from the representations in FIG. 10 to FIG. 12 that by the application of the present invention, it is easy to determine whether or not ink is sufficiently filled in the circumference of discharge heaters by detecting such potential difference by use of potential difference detection means (not shown) provided for the recording apparatus in synchronism with the driving timing of the discharge heaters.

In this respect, the results of potential difference detection thus obtained are not necessarily the same as those shown in FIG. 10 and FIG. 12 due to the structure of circuits and others. Also, depending on the balance between the load and potential, the waveforms differ from those shown above. For example, a waveform appears with positive and negative signs being reversed in some cases.

Figure 13:
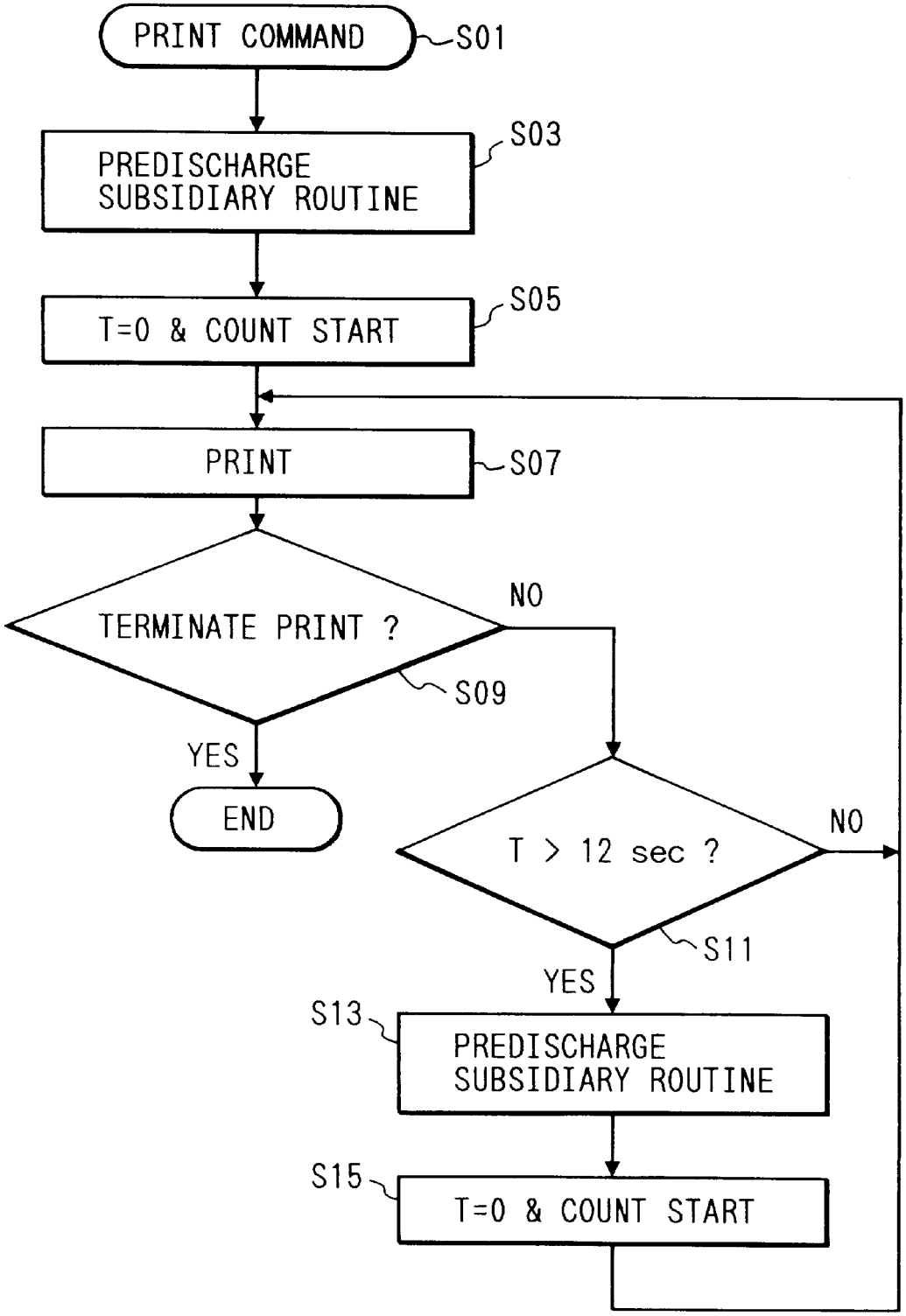
FIG. 13 is a flowchart showing an embodiment of predischarge control applicable to an ink jet recording apparatus in accordance with the present invention.
Figure 14:
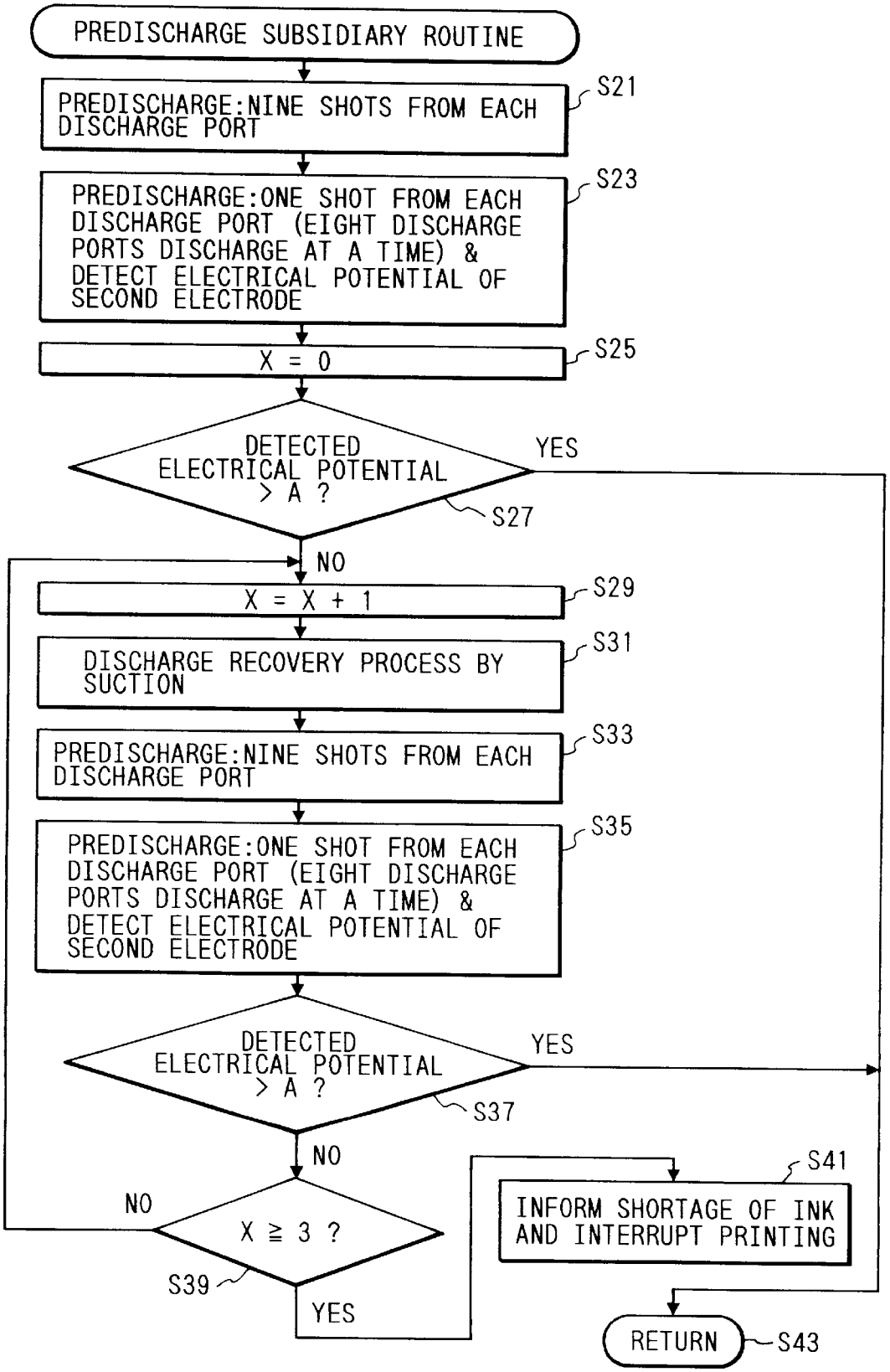
FIG. 14 is a flowchart showing the predischarge subroutine applicable to an ink jet recording apparatus in accordance with the present invention.

FIG. 13 and FIG. 14 are flowcharts showing one example of detection control of ink shortage in accordance with the present embodiment. For the present embodiment, it is assumed that ink shortage is detected by utilizing discharge heater driving at the time of predischarge.

Hereinafter, the flow of ink detection control will be described.

At first, when a printing command is issued (step S01), the cap, which covers the ink discharge ports formed on the recording head, is retracted (the ink discharge ports being in its open state). Then, in this state, a predischarge subroutine shown in FIG. 14 is executed (step S03).

When the predischarge subroutine is completed, a countdown begins with the time T=0. At the same time, the printing begins (steps S05 to S07).

If the printing is not terminated (step S09), the time T after the printing has started is checked (step S11). In other words, when the time exceeds 12 seconds, the predischarge subroutine is again executed (step S13). With the predischarge subroutine being completed, the countdown begins with the time T=0. Then, at the same time, the printing begins (steps S05 to S07).

The predischarge in the predischarge subroutine is such that every other discharge port in one common (adjacent eight discharge ports, n1, n2, . . . , n7 and n8, for example) forms one group (a group of n1, n3, n4, and n5; another group of n2, n4, n6, and n8) to discharge ink simultaneously. In other words, those discharging ink at a time are four per common. As a result, the recording head having 64 discharge ports, which is adopted for the present embodiment, is arranged to execute 16 discharges separately in order to cause each one of the entire discharge ports to discharge one droplet of ink. Also, per predischarge, a total of ten ink droplets are discharged from one discharge port. Here, of the ten droplets of the predischarge, there is a possibility that defective ink filling or the like takes place within the initial seven droplets due to over viscosity of ink resulting from the evaporation of volatile component of ink. Therefore, these droplets are considered incapable of serving as appropriate objects for the detection of disabled discharge by the application of the present invention. With this in view, it is arranged for the present embodiment to detect the potential difference of the filter 970 described above by use of the potential difference detection means (steps S21 and S23) in synchronism with the driving of the discharge heater for the last one droplet, that is tenth droplet of the predischarge from each of the discharge ports. In this way, the ink filling status of the discharge ports is reliably determined. At this juncture, if ink is not filled in, that is, the potential difference is detected to be lower than a certain value A (step S27), a discharge recovery process by means of suction as described above is executed (step S31), and then, the predischarge is again performed, and the potential of the filter is detected as well (steps S33 and S35).

If it is still confirmed that ink is not filled in the discharge ports even after executing the ink presence detection by means of predischarge and the discharge recovery process by means of suction three times in succession (step S39 and others), it is determined that "ink has been exhausted", and an error message is given to the user. At the same time, the current printing is suspended (step S41). On the other hand, if ink filling is confirmed during the three-time continuous execution of discharge recovery process by means of suction, the printing is allowed to begin (step S43).

Thereafter, per 12 seconds the predischarge subroutine is executed until the completion of printing (steps S11, S13, and S15).

In this respect, as shown in FIG. 12, the aforesaid potential difference varies in accordance with the driving power of the discharge heaters, that is, it varies depending on the number of heaters to be driven. Therefore, it is possible to determine the number of discharge ports, for which no ink is filled, just by taking the read of the aforesaid value A. As a result, even when plural discharge heaters are driven at a time as in the present embodiment, it is possible to detect even one discharge port that is not filled with ink. Consequently, by the application of the present invention, not only it is possible to detect the "ink shortage", which causes disabled discharge for all the discharge ports due to the reduced ink remains in the ink tank, but also, the disabled discharge for each individual discharge port due to clogging or the like that may take place in it.

Figure 15:
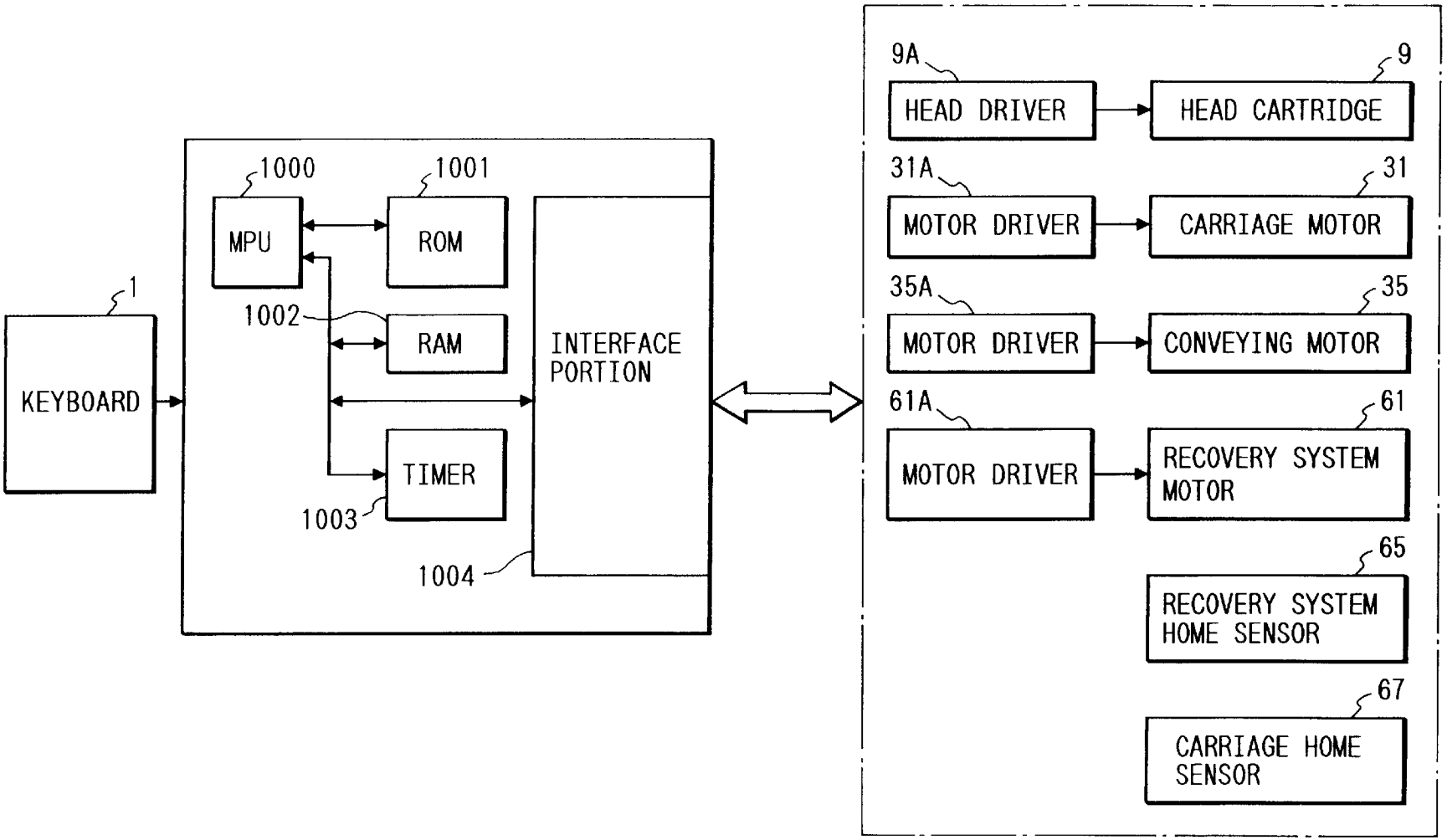
FIG. 15 is a diagram which shows the structural example of a control system applicable to an ink jet recording apparatus in accordance with the present invention.

FIG. 15 is a block diagram showing the structural example of the control system of an ink jet recording apparatus to which the present invention is applicable.

In FIG. 14, the capping position and traveling position of the carrier 11 can be sensed in accordance with the detection by means of home sensor 65 provided for the recovery system or of carrier home sensor 67. Here, a reference numeral 1000 designates an MPU for controlling each unit; 1001, a ROM storing program and others for the execution of the corresponding control procedures; 1002, a RAM used as work area for the execution of the control procedures; 1003, a timer for measuring time; and 1004, an interface unit. In this respect, it is possible to input command data, recording data, and the like for the operation of the control system through the keyboard unit.

(Second Embodiment)

Figure 16:
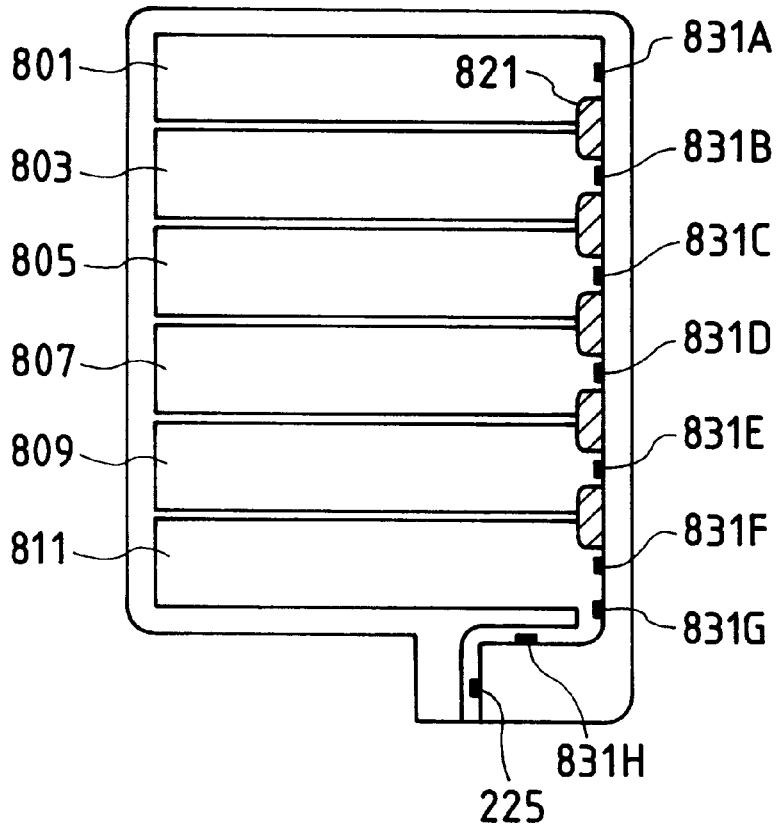
FIG. 16 is a view schematically showing an ink head cartridge representing another example of the arrangement of the second electrode, which is applicable to an ink jet recording apparatus in accordance with the present invention.

FIG. 16 is a view which schematically illustrates the structure of an ink cartridge where a plurality of the aforesaid second electrodes are arranged therefor.

The structure of the ink tank for the ink head cartridge of the present embodiment is such that plural ink tanks 801 to 811 are coupled, and that an absorbent 821 is provided for each of the coupling portions. Also, each of the second electrodes 831A to 831H is arranged in each ink tank. Therefore, in accordance with the present embodiment, ink in the respective ink tanks is consumed completely one after another from the ink tank 801 and on as ink is discharged. In this way, it is possible to determine ink remains by detecting signal from each of the electrodes described above.

Also, in the vicinity of the ink discharge ports, the second electrodes are arranged in a higher concentration in order to enhance the precision with which to sense ink remains in a state of being closer to ink shortage. Therefore, in accordance with the present invention, it is possible to give warning to the user by updating the displayed representation on an indicator or the like in accordance with the current state of ink remains. Also, when the ink remains become less than an amount good enough to print one page, it is possible to avoid any ink shortage while in printing one page by suspending the printing between pages automatically if the result of detection indicates ink shortage at the electrode 831, for example.

(Third Embodiment)

Figure 17:
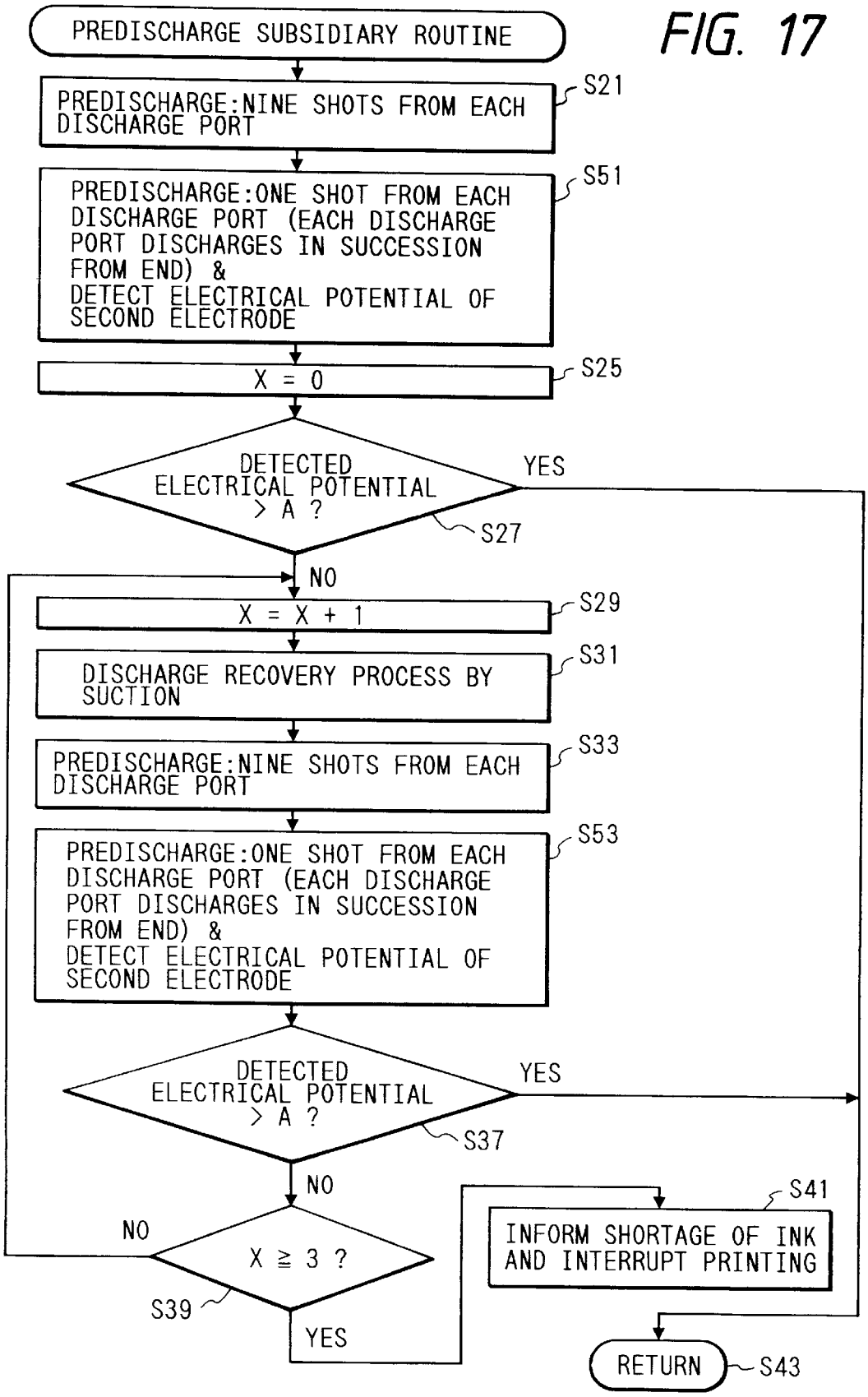
FIG. 17 is a flowchart showing another embodiment of the predischarge subroutine applicable to an ink jet recording apparatus in accordance with the present invention.

FIG. 17 is a flowchart showing another example of the predischarge control in accordance with the present invention. In the present embodiment, the predischarges are performed one after another per discharge (steps S51 and S53). These are steps different from those described in the flowchart shown in FIG. 18.

In this way, it is easy to discriminate the discharge ports that create disabled discharges from those functioning normally. It is also possible to anticipate the enhanced precision of detection.

(Fourth Embodiment)

Figure 18:
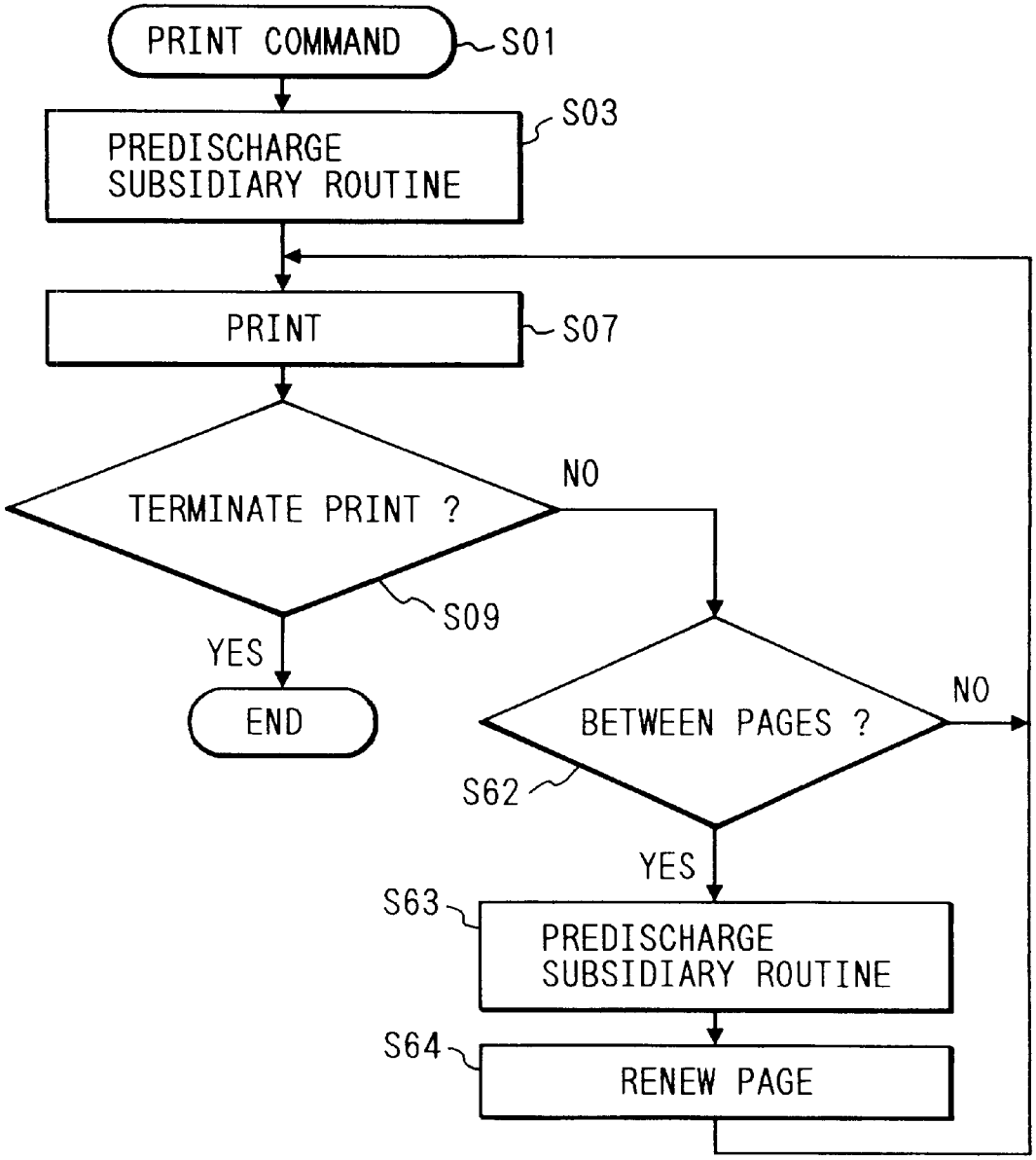
FIG. 18 is a flowchart which shows another embodiment of control applicable to an ink jet recording apparatus in accordance with the present invention.

FIG. 18 is a flowchart showing another detection timing in accordance with the present invention. In the present embodiment, the predischarge for the ink shortage detection described above is executed just before feeding sheet for each page to be printed (steps S61, S62, and S63).

This method is particularly effective in a case where it is impossible to execute the ink remain detection as described in the second embodiment, yet there is a possibility that the ink shortage occurs while in printing. In other words, it is practically useless if ink shortage is detected while any one of pages is being printed, not only because there is no alternative but the recording sheet of that page should be discarded, but also because it invites more waste of ink or lowered throughput, among other drawbacks, due to various controls that are required just in detecting ink shortage.

In this respect, it may be possible to execute the ink shortage detection once for plural pages to be printed. In this respect, the timing for the performance of the ink shortage detection is not necessarily confined to the one described in the present embodiment.

(Fifth Embodiment)

In the embodiments described above, the heat storage layer of the discharge heater is used as dielectric, while the discharge heater as the first electrode, but the present invention is not necessarily limited thereto. For example, as the first electrode, a warming heater on the heater board may be used or dielectric and electrode, which are dedicated to its own use, may be arranged for recording means or the like.

(Sixth Embodiment)

Figure 19A:
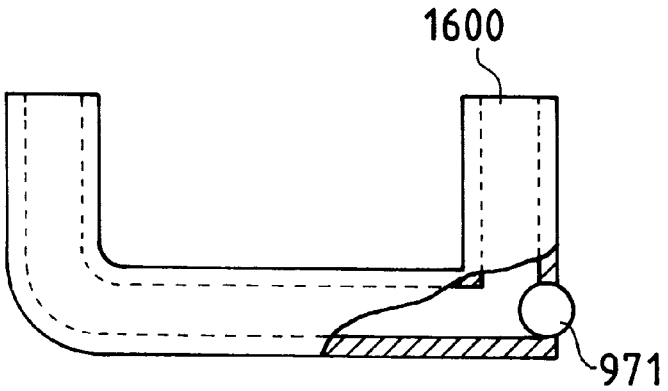
FIGS. 19A and 19B are views schematically showing the ink head cartridge representing another example of the arrangement of the second electrode, which is applicable to an ink jet recording apparatus in accordance with the present invention.
Figure 19B:
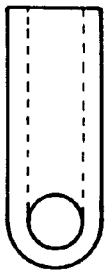

In the embodiments described above, the filter is used as the second electrode, but the present invention is not necessarily limited thereto. For example, it may be possible to form the member 971 by an electric conductor whereby to seal the hole that is needed when the chip tank 1600 is molded for the formation of ink paths as shown in FIGS. 19A and 19B, but should be eliminated when the systems are used. It may also be possible to provide the electrode dedicated to its own use in this respect.

In the present embodiment, the electrical connection with the aforesaid sealing member is arranged by providing a contact with the terminal provided for a carrier (not shown).

(Seventh Embodiment)

Figure 20:
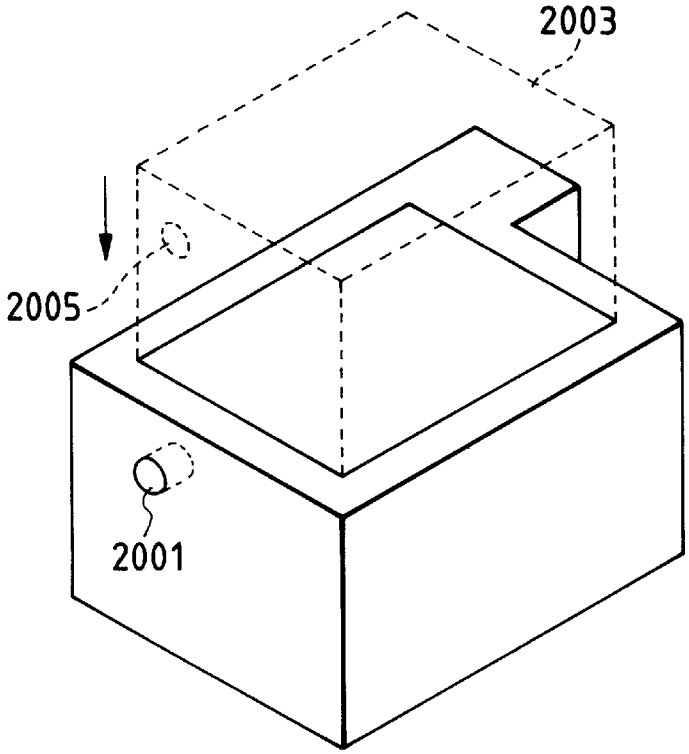
FIG. 20 is a view which shows one example of an ink head cartridge of ink tank separation type applicable to an ink jet recording apparatus in accordance with the present invention.

FIG. 20 is a view which shows an example in which the present invention is applied to the recording head of a type having its ink tank separately. The aforesaid second electrode 2001 is arranged through an separable ink tank 2003 and an electrical contact 2005 arranged for a connector with the recording head. In this way, the present invention is applicable to the apparatus having the recording head and ink tank, which are not necessarily formed integrally. Also, with the structure arranged as in the present embodiment, it is possible to detect defective coupling of ink tank or the like at the same time. In this respect, the second electrode 2001 is reliably connected with the electric circuit through an electrical connector provided for the carrier (not shown).

(Eighth Embodiment)

Figure 21:
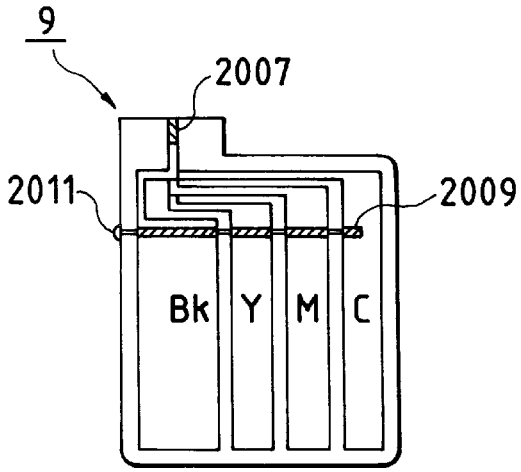
FIG. 21 is a view showing one example of an ink head cartridge capable of discharging plural kinds of ink, which is applicable to an ink jet recording apparatus in accordance with the present invention.

The present invention is not necessarily limited to a recording apparatus for discharging only one kind of ink for obtaining the intended effects, either. For example, it is applicable to a multiple color recording head of an add-on type as shown in FIG. 21. Here, in the present embodiment, the ink discharge elements 2007 for discharging ink of each color (Y, M, C, and Bk) are used as the first electrodes described above, while each color ink is electrically connected by means of wiring 2009. As a result, it is possible to attain the intended detection only by arranging one second electrode 2011 on one terminal of the wiring 2009.

There is no need to arrange both the first and second electrodes in the numbers corresponding to the kinds of ink in order to detect the ink remains for the recording heads for discharging plural kinds of ink. With the present invention arranged in this way, it is possible to attain the intended detection if only at least either one first or second electrode is arranged irrespective of the plural kinds of ink.

In this respect, kinds of ink used for the present embodiment are defined by differences in color, but the present invention is not necessarily limited thereto. Such differences may be defined by usage of ink, ink to be used for print on pulp or ink to be used for print on cotton, for example.

(Ninth Embodiment)

The voltage applied to the first electrode described above is not necessarily the one that is applied to the execution of the predischarge. For example, the application of voltage may be the one given to the printing execution. Also, it may be possible to apply a voltage that is not high enough to allow any ink discharge when printing operation is at rest so as to save any wasteful ink consumption for the efficient attainment of the intended detection.

(Tenth Embodiment)

With the embodiments described above, printing is suspended when at least one ink discharge port is detected as having disabled discharge in accordance with the detected voltage of the second electrode, but the present invention is not necessarily limited thereto. For example, it may be possible to switch controls so that dots to be recorded by the discharge port whose condition is detected as being disabled are recorded by another discharge port still capable of discharging ink. In this way, it is possible to use ink completely without any waste even if unrecoverable discharge takes place in some discharge port before the complete consumption of ink.

(Eleventh Embodiment)

Also, in accordance with the embodiments described above, the bubble jet method using electrothermal transducing elements is adopted for the printing method of recording means, but the present invention is not necessarily limited thereto. For example, an ink jet recording apparatus of piezoelectric type is also useable for obtaining the same effects by arranging the electrodes to which the driving voltage of the piezoelectric elements is applicable or dielectric on the wiring.

(Twelfth Embodiment)

In the first to eleventh embodiments described above, there has been shown the structural example in which dielectric resides between the first and second electrodes, but it is possible to attain the intended detection if only ink is present between them. In accordance with the present embodiment, the structure is made simpler for implementing the invention.

(Thirteenth Embodiment)

In the embodiments described above, ink remains in the ink retaining member or disabled discharge is detected mainly by the detection of potential of the second electrode, but the present invention is not necessarily limited thereto. For example, it may be possible to execute the aforesaid detection by detecting the values of electric current.

(Fourteenth Embodiment)

Figure 22:
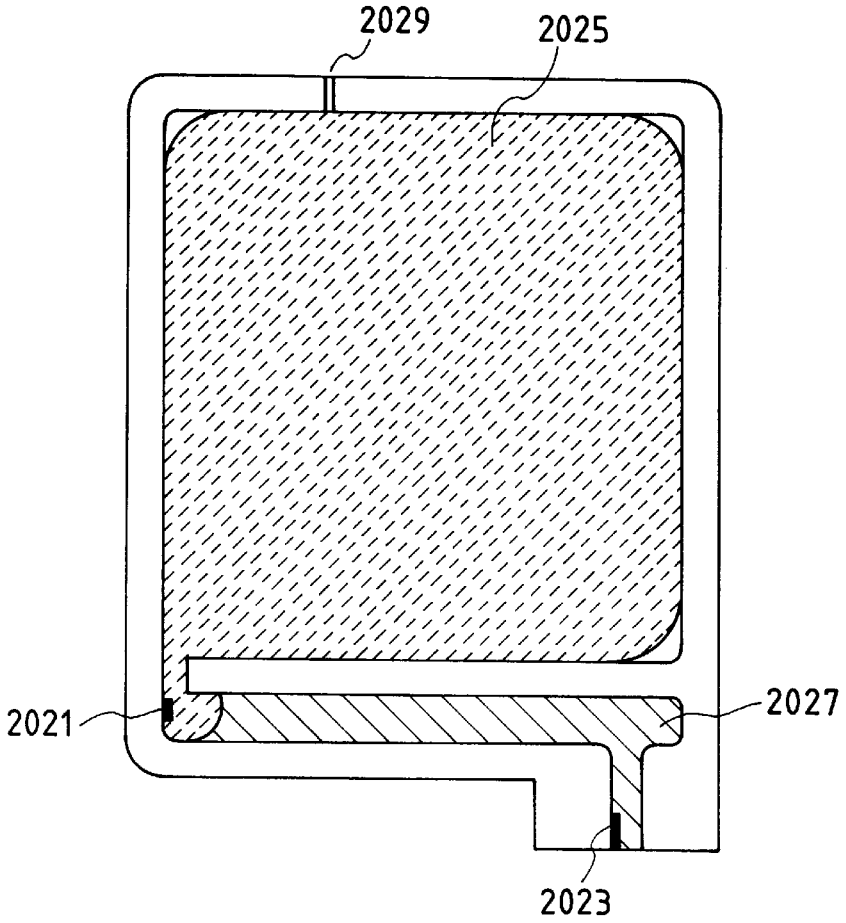
FIG. 22 is a view schematically showing an ink head cartridge representing another example of the arrangement of the first electrode, which is applicable to an ink jet recording apparatus in accordance with the present invention.
Figure 23:
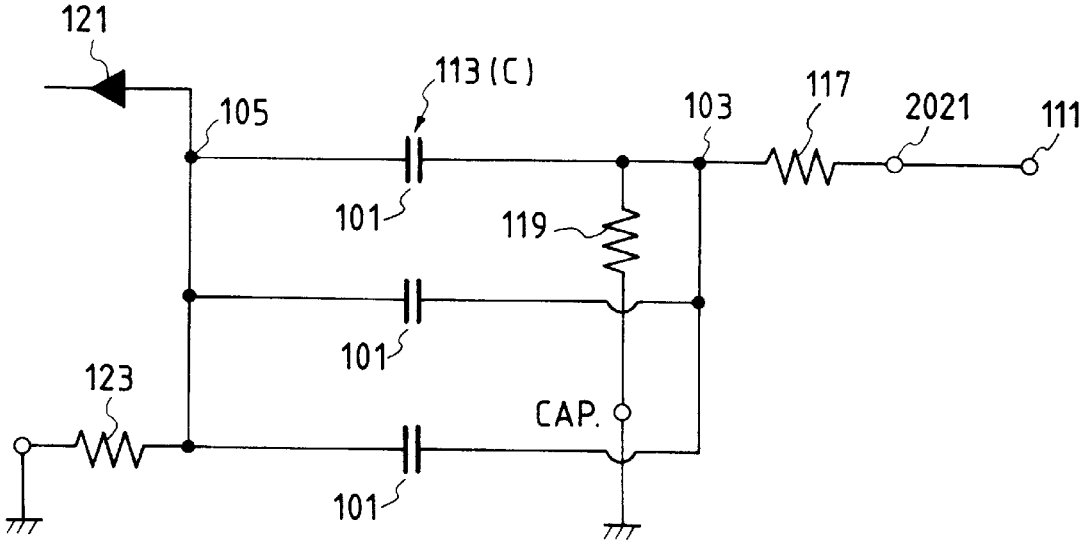
FIG. 23 is a diagram showing the equivalent circuit of a mechanism for detecting ink shortage, which is applicable to an ink jet recording apparatus in accordance with the present invention.

FIG. 22 is a cross-sectional view schematically showing an ink head cartridge in accordance with a fourteenth embodiment. FIG. 23 is a diagram showing its equivalent circuit.

Here, a reference numeral 2021 designates a first electrode installed on an absorbent 2025 serving as ink retaining member in the ink tank, which is positioned in it near an ink discharge port. The first electrode is electrically connected to the driving power-supply. Its structure is arranged so that voltage is applicable with an arbitrary timing. On the other hand, a second electrode 2023 is installed on the substrate of the heater board, but the second electrode 2023 may be either an electrode arranged for its own use or an electrode that functions dually as the discharge heater or may be arranged on the wiring 105 that supplies power to the discharge heater. Therefore, it is unnecessary to install at least the second electrode anew. Also, by detecting potential difference per second electrode, it is possible to detect the condition of ink filling per discharge port. A reference numeral 2027 designates a liquid chamber schematically, which corresponds to the aforesaid chip tank. Here, in FIG. 22, the film covering the second electrode 2023, which serves as dielectric, is omitted.

With the structure described above, air enters the ink tank through an air conducting hole 2029 as ink is reduced. When the air enters the chip tank ultimately, ink serving to electrically connect the first and second electrodes is separated, thus making it possible to detect ink remains by detecting the potential difference between the first and second electrodes in the same way as the first embodiment. Also, with the structure of the present embodiment, there is no need for installing at least the second electrode anew. Further, it is possible to detect the ink filling condition per discharge port by detecting potential difference per second electrode. In this respect, the aforesaid second electrode is not necessarily limited to only one. For example, a plurality of the second electrodes are installed on the aforesaid absorbent so that ink remains can be detected on several stages or, further, it may be possible to arranged them not only on the absorbent, but also in the chip tank, for example.

Of the ink jet recording methods described above, the present invention demonstrates particularly excellent effects when applied to a recording head or a recording apparatus provided with a method of creating changes of state of ink by the application of thermal energy with the provision of means (electrothermal transducing elements, laser beam, or the like) for generating the thermal energy usable as the energy for discharging ink, because it is possible to attain recording in high density as well as in high precision by the application of a method of the kind.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of recording means (recording head), thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharge ports. In other words, in accordance with the present invention, it is possible to perform recording reliably and efficiently irrespective of the modes of recording head.

Further, the present invention is effectively applicable to a recording head of full-line type having a length corresponding to the maximum width of a recording medium recordable by the recording apparatus. For such recording head, it may be possible to adopt either a structure whereby to satisfy the required length by combining a plurality of recording heads or a structure arranged by one recording head integrally formed.

In addition, the present invention is effectively applicable to a recording apparatus of serial type exemplified above, irrespective of whether using the recording head fixed to the apparatus main body; the recording head of an exchangeable chip type, which can be electrically connected with the apparatus main body or to which ink can be supplied from the apparatus main body when it is installed in the apparatus main body, or using the recording head of a cartridge type in which an ink tank is formed integrally with the recording head itself.

Also, for the present invention, it is preferable to additionally provide a recording head with recovery means and preliminarily auxiliary means as constituents of the recording apparatus because these additional means will contribute to making the effectiveness of the present invention more stabilized. To name them specifically, these are capping means for the recording head, cleaning means, suction or compression recovery means as described above, and in addition, recovery means by use of preheating means such as electrothermal transducers or heating elements other than such transducers or the combination of those types of elements, and the adoption of predischarge means for executing discharge other than the regular discharge.

Also, for the kinds and numbers of mounted recording heads, it is possible to provide not only a single head to be used for a monochromic ink, but also, a plurality of heads for use of plural kinds of ink having different colors or densities. In other words, the present invention is extremely effective in applying it not only to a recording mode in which only main color such as black is used, but also to an apparatus having at least one of multiple color modes with ink of different colors, or a full-color mode using the mixture of the colors, irrespective of whether the recording heads are integrally structured or it is structured by a combination of plural recording heads.

Moreover, in the embodiments of the present invention described above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given. In addition, while positively preventing the temperature from rising due to the thermal energy by the use of such energy as an energy to be consumed for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain ink in the form of liquid or solid in the recesses or through holes of a porous sheet such as disclosed in Japanese Patent Laid-Open Application No. 54-56847 or 60-71260 in order to enable the ink to face the electrothermal transducers. In the present invention, the most effective method for the various kinds of ink mentioned above is the one capable of implementing the film boiling method as described above.

Further, as the mode of an ink jet recording apparatus of the present invention, which is usable as output means of an information processing apparatus, it is possible to adopt the ink jet recording apparatus as an image output terminal of a computer or other information processing equipment. Also, as examples of information processing equipment provided with the ink jet recording apparatus of the present invention, a copying machine combined with a reader or the like, and an apparatus providing a mode of a facsimile equipment provided with transmitting and receiving functions can be named, among others. Each information processing equipment described above is provided with a controller for the required control of the aforesaid ink jet recording apparatus.

Now, as described above, an ink jet recording apparatus in accordance with the present invention is arranged to utilize the electric capacitance that is kept partially or totally by its recording means, while it is provided with a first electrode arranged on the recording means as well as a second electrode having dielectric and recording ink between the first and second electrodes, and also, arranged to determine the status of ink residing between the first and second electrodes by detecting potential appearing on the second electrode when voltage is applied to the first electrode; hence discriminating whether discharging is possible or impossible. The ink shortage is accurately detected with a simple structure, while minimize the cost increase, in such a manner that the electrode already arranged for the ink discharge heater or the ink warming heater is used as the first electrode, with the heat storage layer formed by $SiO_2$ film or the like, which covers the substrate constituting the discharge heaters and others, being adopted as the aforesaid dielectric. In other words, the aforesaid potential difference is detected by means for detecting it in synchronism with the driving timing of the discharge heaters, hence making it possible to easily determine whether or not ink is filled sufficiently in the circumference of each of the discharge heaters. Also, it is possible to give warning to the user by updating the contents of representation indicated by the second electrodes arranged in the vicinity of each discharge port for the enhancement of precision with which to sense the reduction of ink remains in a state of being closer to the ink shortage. It is also possible to give warning to the user after suspending printing between pages automatically to avoid any ink shortage while a pages is being printed if the ink remains should become smaller than an amount good enough to print one page, and at the same time, the result of detection indicates any ink shortage at a given electrode. Furthermore, a structure is arranged for the ink tank of an ink head cartridge so that a plurality of ink tanks are coupled in it with each absorbent being provided for the respective coupling portion, and that the second electrode is arranged for each of the tanks. In this way, ink in each tank is consumed one after another as ink is being discharged, while making it possible to detect ink remains reliably by detecting the respective signals transmitted from each of the electrodes thus arranged.

What is claimed is:

1. An ink jet recording apparatus for recording by discharging ink onto a recording medium by use of recording means for recording inputted image information and an ink retaining member for supplying ink to said recording means, comprising:

at least one first electrode;

dielectric adjacent to said first electrode or lying between said first electrodes;

a second electrode electrically connecting with said first electrode through said dielectric and ink;

means for applying voltage for applying and releasing voltage to and from said first electrode;

means for detecting the potential of said second electrode; and determining means to determine the reduced ink remains at least either in said recording means or said ink retaining member in accordance with the potential of said second electrode detected by said means for detecting potential, wherein said first electrode is comprised of an ink discharging element driven electrically or a wiring connected to said element.

2. An ink jet recording apparatus according to claim 1, wherein the application of voltage to said first electrode and the detection of voltage of said second electrode are made per said ink discharging element.

3. An ink jet recording apparatus for recording by discharging ink onto a recording medium by use of recording means for recording inputted image information and an ink retaining member for supplying ink to said recording means, comprising:

at least one first electrode;

dielectric adjacent to said first electrode or lying between said first electrodes;

a second electrode electrically connecting with said first electrode through said dielectric and ink;

means for applying voltage for applying and releasing voltage to and from said first electrode;

means for detecting the potential of said second electrode; and determining means to determine the reduced ink remains at least either in said recording means or said ink retaining member in accordance with the potential of said second electrode detected by said means for detecting potential, wherein said first electrode is comprised of a heater for use of ink warming.

4. An ink jet recording apparatus for recording by discharging ink onto a recording medium by use of recording means for recording inputted image information and an ink retaining member for supplying ink to said recording means, comprising:

at least one first electrode;

dielectric adjacent to said first electrode or lying between said first electrodes;

a second electrode electrically connecting with said first electrode through said dielectric and ink;

means for applying voltage for applying and releasing voltage to and from said first electrode;

means for detecting the potential of said second electrode; and determining means to determine the reduced ink remains at least either in said recording means or said ink retaining member in accordance with the potential of said second electrode detected by said means for detecting potential, wherein said recording means is comprised of color recording means capable of discharging plural kinds of ink, at the same time, being provided with at least one first electrode per kind of ink, while only one second electrode being arranged for common use by each kind of ink.

5. An ink jet recording apparatus for recording by discharging ink onto a recording medium by use of recording means for recording inputted image information, said apparatus comprising:

at least one first electrode;

a dielectric adjacent to said first electrode;

a second electrode electrically connecting with said first electrode through at least said dielectric and ink when ink exists between said dielectric and said second electrode;

means for applying and releasing voltage to and from said first electrode;

detecting means for detecting a potential of said second electrode; and determining means for determining a reduction of ink remains between said dielectric and said second electrode in accordance with the potential of said second electrode detected by said detecting means, wherein said first electrode is comprised of an ink discharging element driven electrically or a wiring connected to said element.

6. An ink jet recording apparatus for recording by discharging ink onto a recording medium by use of recording means for recording inputted image information, said apparatus comprising:

at least one first electrode;

a dielectric adjacent to said first electrode;

a second electrode electrically connecting with said first electrode through at least said dielectric and ink when ink exists between said dielectric and said second electrode;

means for applying and releasing voltage to and from said first electrode;

detecting means for detecting a potential of said second electrode; and determining means for determining a reduction of ink remains between said dielectric and said second electrode in accordance with the potential of said second electrode detected by said detecting means, wherein said first electrode is comprised of a heater for use of ink warming.

7. An ink jet recording apparatus for recording by discharging ink onto a recording medium by use of recording means for recording inputted image information, said apparatus comprising:

at least one first electrode;

a dielectric adjacent to said first electrode;

a second electrode electrically connecting with said first electrode through at least said dielectric and ink when ink exists between said dielectric and said second electrode;

means for applying and releasing voltage to and from said first electrode;

detecting means for detecting a potential of said second electrode; and determining means for determining a reduction of ink remains between said dielectric and said second electrode in accordance with the potential of said second electrode detected by said detecting means, wherein said first electrode is comprised of color recording means capable of discharging plural kinds of ink at the same time, being provided with at least one first electrode per kind of ink, and being provided with only one second electrode for common use by each kind of ink.

8. An ink jet recording apparatus according to claim 5, 6 or 7, wherein said determining means further comprises means for determining said ink remains at least in two stages.

9. An ink jet recording apparatus according to claim 5, 6 or 7, wherein said second electrode comprises a filter arranged in an ink path in said recording means, and formed by an electrically conductive material.

10. An ink jet recording apparatus according to claim 5, 6 or 7, wherein said second electrode is arranged in an ink path of said recording means and comprises a sealing member for a hole.

11. An ink jet recording apparatus according to claim 5, 6 or 7, wherein a timing for making the detection of potential of said second electrode is set so that said detection is performed between pages to be printed.

12. An ink jet recording apparatus according to claim 5, 6 or 7, wherein the application of voltage to the first electrode for the detection of potential of said second electrode is different from the application of voltage for recording.

13. An ink jet recording apparatus according to claim 5, 6 or 7, wherein the application of voltage to the first electrode for the detection of potential of said second electrode is the application of voltage for recording.

14. An ink jet recording apparatus according to claim 5, 6 or 7, wherein a discharge recovery process is executed by forcibly exhausting ink from the discharge ports in accordance with a result of determination made by said determining means.

15. An ink jet recording apparatus according to claim 5, 6 or 7, wherein recording is interrupted or suspended in accordance with a result of determination made by said determining means.

16. An ink jet recording apparatus according to claim 5, 6 or 7, wherein dots to be recorded and expected to be discharged from an ink discharge port determined to be in a state of disabled ink discharging are recorded by another ink discharge port.

17. An ink jet recording apparatus according to claim 5, 6 or 7, wherein said first electrode or second electrode is arranged in a plurality in the ink retaining member, and the amounts of ink existing across the adjacent electrodes of said plural second electrodes are equal or smaller as the electrodes are placed closer to an ink discharge port.

18. An ink jet recording apparatus according to claim 5, 6 or 7, wherein means for notifying the state of a recording apparatus, or recording means, or means for retaining ink, or ink is provided in accordance with a result of determination made by said determining means.

19. An ink jet recording apparatus according to claim 5, 6 or 7, wherein said second electrode is arranged for a coupling portion between recording means and means for retaining ink.

20. An ink jet recording apparatus according to claim 5, 6 or 7, wherein means for generating thermal energy is used as means for discharging ink.

* * * * *